US008474807B2

(12) United States Patent
Asami et al.

(10) Patent No.: US 8,474,807 B2
(45) Date of Patent: Jul. 2, 2013

(54) CONVEYING DEVICE, SPINE FORMING DEVICE, AND IMAGE FORMING SYSTEM

(75) Inventors: Shinji Asami, Tokyo (JP); Nobuyoshi Suzuki, Tokyo (JP); Naohiro Kikkawa, Kanagawa (JP); Kazuhiro Kobayashi, Kanagawa (JP); Tomohiro Furuhashi, Kanagawa (JP); Kiichiroh Gotoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/534,474

(22) Filed: Jun. 27, 2012

(65) Prior Publication Data

US 2012/0269601 A1 Oct. 25, 2012

Related U.S. Application Data

(62) Division of application No. 12/923,896, filed on Oct. 13, 2010.

(30) Foreign Application Priority Data

Oct. 30, 2009 (JP) ..... 2009-250840

(51) Int. Cl.
*B31F 1/00* (2006.01)

(52) U.S. Cl.
USPC ..... 270/45; 270/37; 270/46

(58) Field of Classification Search
USPC ..... 270/32, 37, 45, 46, 51
See application file for complete search history.

(56) References Cited

U.S. PATENT DOCUMENTS

| | | | | |
|---|---|---|---|---|
| 6,575,446 | B2 | 6/2003 | Wakabayashi et al. | |
| 6,905,118 | B2 * | 6/2005 | Yamada et al. | 270/8 |
| 7,000,912 | B2 | 2/2006 | Tamura et al. | |
| 7,328,892 | B2 | 2/2008 | Asami et al. | |
| 7,552,917 | B2 | 6/2009 | Hayashi et al. | |
| 7,975,999 | B2 * | 7/2011 | Fukasawa et al. | 270/37 |
| 2008/0211158 | A1 * | 9/2008 | Fukasawa et al. | 270/1.01 |
| 2009/0137374 | A1 | 5/2009 | Kobayashi et al. | |
| 2009/0152789 | A1 | 6/2009 | Kikkawa et al. | |
| 2009/0200725 | A1 | 8/2009 | Tamura et al. | |
| 2009/0258774 | A1 | 10/2009 | Suzuki et al. | |

FOREIGN PATENT DOCUMENTS

| | | |
|---|---|---|
| JP | 2001-260564 | 9/2001 |
| JP | 2007-098874 | 4/2007 |
| JP | 2007-237562 | 9/2007 |
| JP | 2007237562 A * | 9/2007 |

* cited by examiner

*Primary Examiner* — Leslie A Nicholson, III
(74) *Attorney, Agent, or Firm* — Harness, Dickey & Pierce P.L.C.

(57) ABSTRACT

A conveying device that conveys a sheet bundle with a flattened back-face portion includes a first conveying unit, a driving unit, and a second conveying unit. The first conveying unit retracts to a position where no driving force is exerted on the sheet bundle before a leading end of the sheet bundle formed in a flat spine shape enters, and abuts on the sheet bundle to exert conveying force after the leading end of the sheet bundle passes a conveying position. The driving unit moves the first conveying unit to retract to the position and to abut on the sheet bundle. The second conveying unit is positioned on an upstream side of the first conveying unit in a sheet bundle conveying direction and conveys the sheet bundle towards the first conveying unit.

9 Claims, 15 Drawing Sheets

| FIG. 19A |
| --- |
| FIG. 19B |

CONVEYING DEVICE, SPINE FORMING DEVICE, AND IMAGE FORMING SYSTEM

CROSS-REFERENCE TO RELATED APPLICATIONS

This application is a Divisional of U.S. application Ser. No. 12/923,896 filed Oct. 13, 2010, which claims priority from Japanese Patent Application No. 2009-250840 filed in Japan on Oct. 30, 2009, the contents of the applications are hereby incorporated by reference in their entirety.

BACKGROUND

1. Field of the Invention

Example embodiments relate to a conveying device that conveys a sheet bundle formed by stitching sheet-like recording media such as paper sheets, recording paper, and transfer paper (hereinafter, simply referred to as "sheet"), and by folding the stitched sheet-like recording media; a spine forming device provided with the conveying device and a spine forming unit that forms a back portion of the sheet bundle in a flat shape; and an image forming system provided with the spine forming device and an image forming device.

2. Description of the Related Art

In saddle stitch bookbinding that is widely used as simple bookbinding, the need to make the height of a fold (bulge) smaller after bookbinding is very high. Bound booklets are usually handled in stacks of dozens for transportation, delivery, and the like. However, each of the half folded and saddle stitched booklets has a bulge, which makes them unstable and easy to topple when they are stacked.

More specifically, when a sheet bundle is saddle stitched and folded in the middle (double fold), the double folded sheet bundle is likely to have a bulge in the thickness direction near the folding portion and look unattractive. In addition, when the sheet bundle has the bulge near the folding portion, the back side becomes thicker while the fore-edge side is thinner as a booklet. Accordingly, when the sheet bundles are stacked facing the same direction, the stack becomes more lopsided as more booklets are stacked. Consequently, when a large number of sheet bundles are stacked, the stack topples because of excessive tilting, making it difficult to stack a large number of sheet bundles.

In contrast, when a booklet is formed with the folding portion of a double folded sheet bundle flattened like a spine, the bulge of the booklet is pressed, whereby a large number of such booklets can be stacked. In other words, even a couple of booklets with a bulge topple easily when stacked on a desk, creating a problem in handling such as storage and transportation. When a back portion corresponding to the folding portion is flattened, the bulge can be reduced to a bare minimum, thereby resolving the problem. The back portion here means the portion including a spine that is a back face and portions of a front cover and a rear cover connecting to the spine (hereinafter, referred to as back-face portion), and corresponds to the portion opposite to the fore edge.

As for the techniques specific to flattening a booklet, inventions disclosed in the following three patent documents, for example, are known. In the invention disclosed in Japanese Patent Application Laid-open No. 2001-260564, a front cover and a rear cover of a pamphlet composed of a sheet bundle folded so that a back portion has a curvature are fixed by clamping adjacently to the back portion with a pressing unit, and a forming roller is applied once or more along the lengthwise direction of the projected back portion with a pressure sufficient to smooth out the curvature to flatten the back portion.

Japanese Patent Application Laid-open No. 2007-98874 discloses that, similarly to the invention disclosed in Japanese Patent Application Laid-open No. 2001-260564, a folding portion of a saddle stitched booklet is clamped and a back face of the booklet is pressed by moving a roller to flatten the folding portion so as to reduce the height of the fold. However, when delivering the flattened booklet, the booklet is conveyed downstream by an ordinary roller pair.

These inventions have an effect of flattening the curvature of the back portion. However, because a face is formed at the back portion of the booklet by locally and continuously pressing the back portion with a pressing roller, wrinkles and tears are likely to occur on the back face and in the stitched portion. In addition, the roller is moved along the folding portion, resulting in a long forming time.

Japanese Patent Application Laid-open No. 2007-237562 discloses a sheet bundle forming device including: a clamping unit that clamps a portion other than a periphery of the back portion of a folded sheet bundle in the thickness direction; a back portion pressing unit that presses the back portion in the direction toward the fore edge and opposite to the back portion by pressing a back portion pressing face formed on a back portion pressing member to the back portion of the clamped sheet bundle; and a compressing unit that forms the periphery of the back portion of the sheet bundle by compressing the periphery of the pressed sheet bundle in the thickness direction. In this invention, the compressing unit compresses the portions of the front cover and the rear cover near the fold having a bulge resulted by pressing the back portion in the fore edge direction by the back portion pressing unit, in an attempt to reduce the bulge.

However, as in the invention disclosed in Japanese Patent Application Laid-open No. 2001-260564, when the projected portion is partially deformed by the contact of the roller, wrinkles and the like tend to appear in a direction perpendicular to the fold, giving it an unattractive appearance. Furthermore, when the size of the sheet is larger, because of the traveling time of the roller required, productivity may deteriorate depending on the number of sheets in a bundle. More specifically, due to the recent circumstances of energy conservation, in a device of this type, it is important to obtain an energy saving effect by efficiently operating the device. Generally, when efficiency is considered, the processing conditions such as the pressure applied and the amount of repetitions differ depending on the number of sheets, paper thickness, and paper type. However, in work using a roller as disclosed in Japanese Patent Application Laid-open No. 2001-260564, the fact that the number of repeats of the roller run is the only option available leads to a problem in that the work cannot be performed under the most efficient condition.

In the invention disclosed in Japanese Patent Application Laid-open No. 2007-98874, because the booklet is conveyed by the ordinary roller pair at the time of delivery, the leading end (stitched portion) of the flattened booklet is gripped by the nip of the roller pair. Consequently, the folding portion is deformed when gripped by the nip, and in the worst case, wrinkles, smudges, and the like appear on the flattened portion, deteriorating the quality of bookbinding. Particularly, when the booklet has a large number of sheets and is thick, the contact angle with respect to the outer circumference of the roller becomes large, making the damage to the back-face portion of the booklet more prominent. To prevent this, the diameter of the roller could be increased so as to make the contact angle smaller. However, when the diameter of the roller is increased, a space is required to accommodate that increased diameter roller.

In the invention disclosed in Japanese Patent Application Laid-open No. 2007-237562, the occurrence of wrinkles and tears can be reduced and the face can be formed on the back portion of the booklet. However, to press the back portion in the fore edge direction and then to flatten the front cover and the rear cover by compressing them with the compressing unit, the multiple units of the clamping unit, the back portion pressing unit, the compressing unit, and the like need to be operated in sequence after the booklet is stopped by abutting on a stop plate. This results in an insufficient effect of shortening the working time.

SUMMARY

It is an object of example embodiments to at least partially solve the problems in the conventional technology.

According to one aspect of an example embodiment of the present invention, there is provided a conveying device that conveys a sheet bundle with a flattened back-face portion. The conveying device includes a first conveying unit, a driving unit, and a second conveying unit. The first conveying unit retracts to a position where no driving force is exerted on the sheet bundle before a leading end of the sheet bundle formed in a flat spine shape enters, and abuts on the sheet bundle to exert conveying force after the leading end of the sheet bundle passes a conveying position. The driving unit moves the first conveying unit to retract to the position and to abut on the sheet bundle. The second conveying unit is positioned on an upstream side of the first conveying unit in a sheet bundle conveying direction, and conveys the sheet bundle towards the first conveying unit.

According to another aspect of an example embodiment of the present invention, there is provided a spine forming device including: a conveying device and a spine forming unit. The conveying device conveys a sheet bundle with a flattened back-face portion. The conveying device includes a first conveying unit, a driving unit, and a second conveying unit. The first conveying unit retracts to a position where no driving force is exerted on the sheet bundle before a leading end of the sheet bundle formed in a flat spine shape enters and, abuts on the sheet bundle to exert conveying force after the leading end of the sheet bundle passes a conveying position. The driving unit moves the first conveying unit to retract to the position and to abut on the sheet bundle. The second conveying unit is positioned on an upstream side of the first conveying unit in a sheet bundle conveying direction and conveys the sheet bundle towards the first conveying unit. The spine forming unit forms the spine shape by flattening out from a leading end of a folding portion of the sheet bundle and from both sides of the sheet bundle. The spine forming unit is arranged on an upstream side of the first conveying unit and on a downstream side of the second conveying unit.

According to still another aspect of an example embodiment of the present invention, there is provided an image forming system including an image forming device and a spine forming device. The image forming device forms an image on a sheet. The spine forming device includes a conveying device that conveys a sheet bundle with a flattened back-face portion. The conveying device includes a first conveying unit, a driving unit, and a second conveying unit. The first conveying unit retracts to a position where no driving force is exerted on the sheet bundle before a leading end of the sheet bundle formed in a flat spine shape enters, and abuts on the sheet bundle to exert conveying force after the leading end of the sheet bundle passes a conveying position. The driving unit moves the first conveying unit to retract to the position and to abut on the sheet bundle. The second conveying unit is positioned on an upstream side of the first conveying unit in a sheet bundle conveying direction, and conveys the sheet bundle towards the first conveying unit. The spine forming unit forms the spine shape by flattening out from a leading end of a folding portion of the sheet bundle and from both sides of the sheet bundle. The spine forming unit is arranged on an upstream side of the first conveying unit and on a downstream side of the second conveying unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is a schematic diagram for explaining an operation of the sheet post-processing device of when a sheet bundle is taken in;

FIG. 11 is a schematic diagram for explaining a spine forming operation of the spine forming device of when the sheet bundle is taken in;

DETAILED DESCRIPTION OF EXAMPLE EMBODIMENTS

Figure 1:
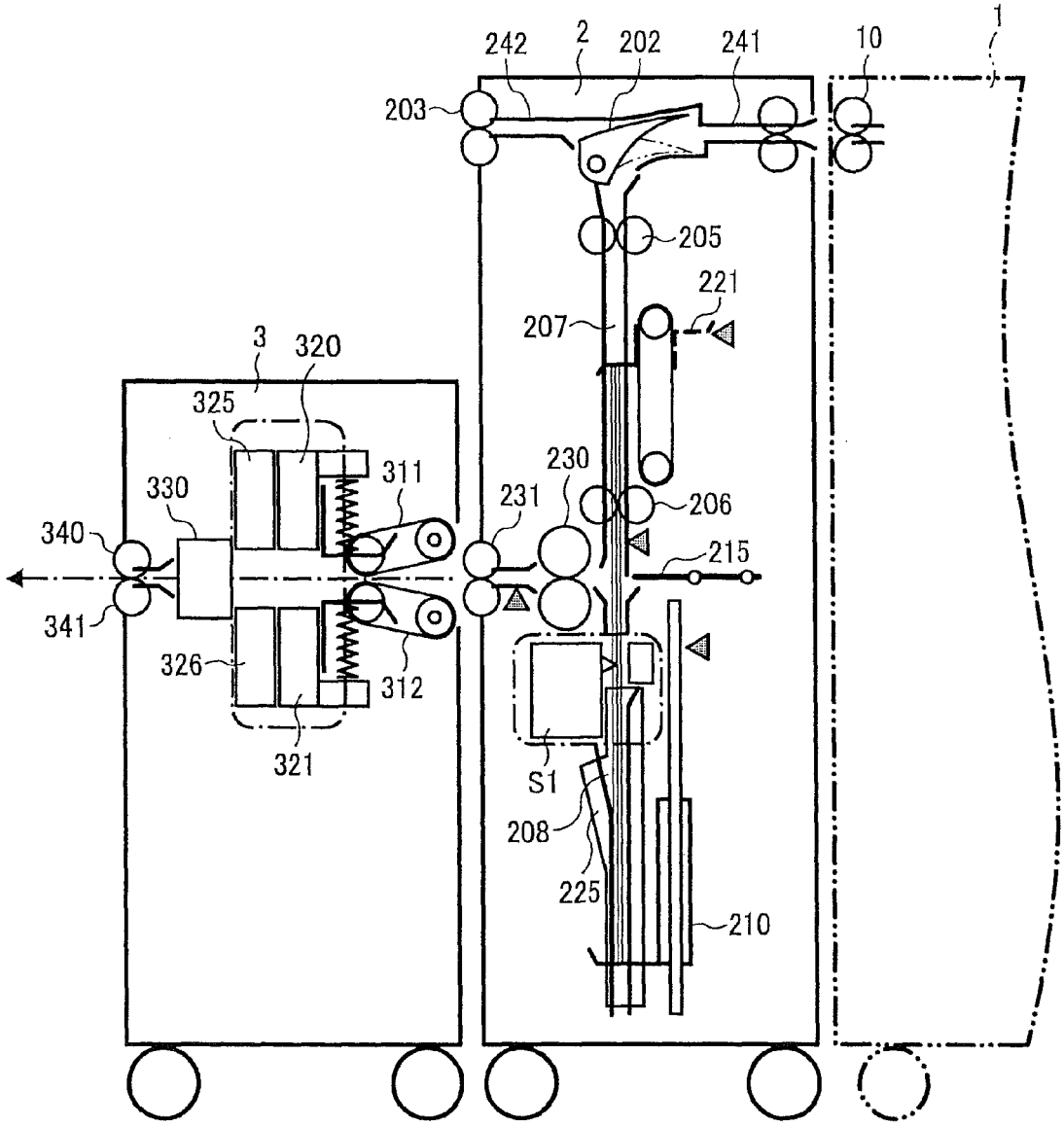
FIG. 1 is a schematic diagram illustrating a system structure of a sheet processing system for forming a spine according to an embodiment of the present invention, the sheet processing system being provided with a sheet post-processing device, a saddle stitch bookbinding device, and a spine forming device.

Example embodiments form nearly right angles between the back face including the folding portion and the portions of the front cover and the rear cover, such that a so-called square spine is formed by flatly forming a folding portion of a sheet bundle that forms a booklet and by flattening with pressure a back-face portion of the booklet that includes the folding portion and portions of a front cover and a rear cover near the folding portion. This allows a large number of booklets to be stacked flatly without causing any problems in handling such as storage, transportation, and the like. To form a spine in such a way, a conveying unit, conveying guide plates, an auxiliary clamping unit, a pressure clamping unit, and a stop unit are arranged in this order from the upstream side of the sheet bundle in the conveying direction. A sheet bundle that is saddle stitched and folded in the middle is conveyed by the conveying unit to abut on the stop unit that lies on the most downstream side so as to form a bulge at the leading end of the sheet bundle in the conveying path, and the sheet bundle is stopped and held fixed. The clamping clearances of the conveying guide plates on the upstream side, the auxiliary clamping unit, and the pressure clamping unit are then narrowed sequentially in that order to apply pressure such that the bulge is converged towards the downstream in sequence. Finally, while the leading end of the sheet bundle is being pressed against the stop unit, the sheet bundle is clamped and pressure is applied thereon by the pressure clamping unit. This forms the back-face portion of the sheet bundle in an angular U-shape viewed from the top fore-edge side.

In this case, a delivery conveying unit is configured with a pair of rollers that conveys the booklet in a delivery direction and at least one of which is movable between a pressure contacting position where the pair of rollers comes closer to each other and a separated position where the pair of rollers remains apart from each other. Delivery conveying members are moved to the retracted position before a flat face formed portion of the booklet conveyed by the conveying unit reaches conveying members of the delivery conveying unit and, before the trailing end of the booklet reaches the pair of conveying members, the pair of delivery conveying members is moved to the contacting position to convey the booklet in the delivery direction. This prevents the shape of the spine from being damaged because the pressure is not exerted on the flat face formed portion of the booklet when it enters the nip of the rollers.

Exemplary embodiments according to the present invention are described below in greater detail with reference to the accompanying drawings. In the following description, the same reference numerals and marks are given to equivalent elements, and redundant explanations are appropriately omitted.

FIG. 1 is a block diagram illustrating a system structure of a sheet processing system for processing and forming a spine provided with a sheet post-processing device, a saddle stitching device, and a spine forming device. When this system is connected to a subsequent stage of an image forming device and the spine processing is performed, the system as a whole functions as an in-line bookbinding system that can perform processes from image forming process to bookbinding process.

In the outline of this system, a saddle stitching process is performed to a sheet bundle fed from sheet bundle delivery rollers 10 of a sheet post-processing device 1 into a saddle stitch processing device 2. The sheet bundle is folded in the middle and then conveyed from lower delivery rollers 231 to a spine forming device 3. The spine forming device 3 forms a folding portion (back-face portion) of the sheet bundle into a flat shape and delivers the sheet bundle to outside of the device. An image forming device 100 is a device that forms a visible image on a sheet-like recording medium based on image data input or image data of a scanned image and that corresponds to, for example, a copier, a printer, a facsimile, and a digital multifunction product (see MFP in FIG. 19) with at least two of these functions. The section that forms an image is a printer engine and the section that scans an image is a scanner engine, both of which correspond to an engine 110 indicated in later-described FIG. 19.

Figure 2:
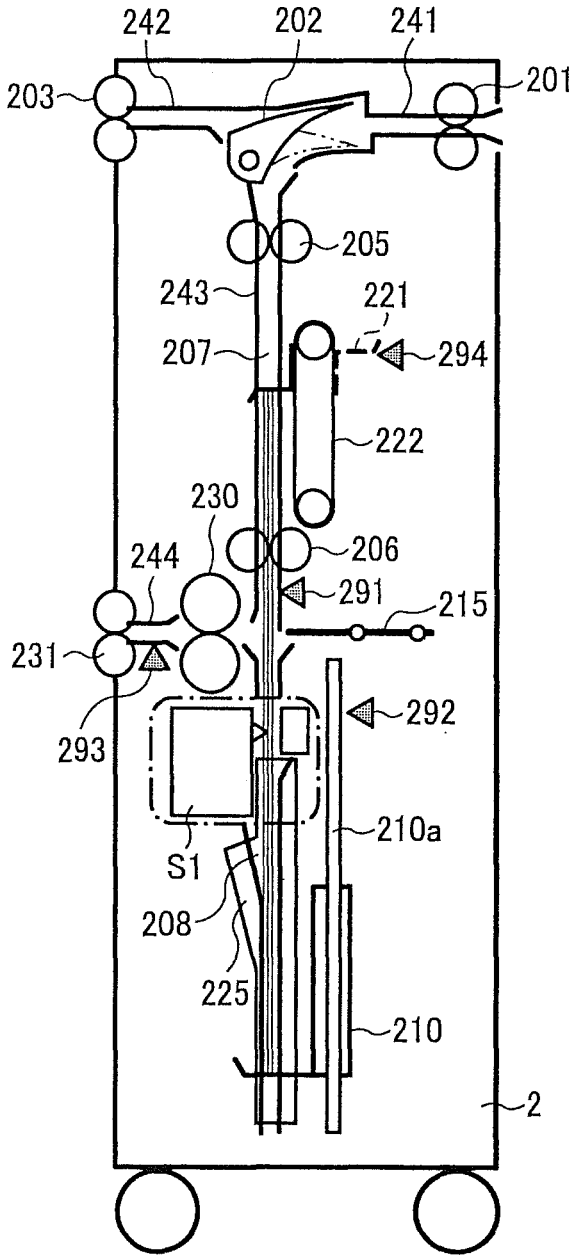
FIG. 2 is a front elevational view illustrating details of the sheet post-processing device indicated in FIG. 1.

FIG. 2 is a schematic diagram illustrating detailed structure of the saddle stitch bookbinding device indicated in FIG. 1. In FIG. 2, the saddle stitch bookbinding device 2 is provided with an entrance conveying path 241, a sheet-through conveying path 242, and a middle folding conveying path 243. At the most upstream portion of the entrance conveying path 241 in a sheet conveying direction, entrance rollers 201 are provided and a sheet bundle aligned is fed into the device from the sheet bundle delivery rollers 10 of the sheet post-processing device 1. In the following explanation, the upstream side in the sheet conveying direction is simply referred to as the upstream side, and the downstream side in the sheet conveying direction is simply referred to as the downstream side.

On the downstream side of the entrance rollers 201 in the entrance conveying path 241, a branching claw 202 is provided. The branching claw 202 is arranged in a horizontal direction in the drawing, and the conveying direction of the sheet bundle is diverged to the sheet-through conveying path 242 or to the middle folding conveying path 243 by the branching claw 202. The sheet-through conveying path 242 extended horizontally from the entrance conveying path 241 is a conveying path to lead the sheet bundle to a processing device or a catch tray in a subsequent stage not indicated, and the sheet bundle is delivered to the subsequent stage by upper delivery rollers 203. The middle folding conveying path 243 is a conveying path that extends below in a vertical direction from the branching claw 202 to perform saddle stitching and middle folding to the sheet bundle.

The middle folding conveying path 243 is provided with an upper bundle conveying guide plate 207 that guides the sheet bundle above a folding plate 215 for middle folding and a lower bundle conveying guide plate 208 that guides the sheet bundle below of the folding plate 215. On the upper bundle conveying guide plate 207, from the top, upper bundle conveying rollers 205, a trailing end tapping claw 221, and lower bundle conveying rollers 206 are provided. The trailing end tapping claw 221 is mounted in a standing manner on a trailing end tapping claw drive belt 222 driven by a drive motor not indicated. The trailing end tapping claw 221 aligns the sheet bundle by tapping (pressing) the trailing end of the sheet bundle on a later-described movable fence by the reciprocating rotational movement of the trailing end tapping claw drive belt 222. When the sheet bundle is fed and when the sheet bundle is raised for middle folding, the trailing end tapping claw 221 is retracted from the middle folding conveying path 243 along the upper bundle conveying guide plate 207 (position indicated by a broken line in FIG. 2). A reference numeral 294 represents a trailing end tapping claw home position (HP) sensor for detecting a home position of the trailing end tapping claw 221, and the trailing end tapping claw HP sensor detects the position indicated by the broken line in FIG. 2 where the trailing end tapping claw 221 is retracted from the middle folding conveying path 243 as the home position. The trailing end tapping claw 221 is controlled with reference to this home position.

On the lower bundle conveying guide plate 208, from the top, a saddle stitching stapler S1, a pair of saddle stitching jogger fences 225, and a movable fence 210 are provided. The lower bundle conveying guide plate 208 is a guiding plate that receives the sheet bundle conveyed through the upper bundle conveying guide plate 207, and is arranged with the pair of saddle stitching jogger fences 225 in the width direction and with the movable fence 210 below that abuts (supports) the leading end of the sheet bundle and is movable vertically.

The saddle stitching stapler S1 is a stapler that staples the mid-portion of the sheet bundle. The movable fence 210 moves in the vertical direction while supporting the leading end of the sheet bundle and positions the middle position of the sheet bundle to the position facing the saddle stitching stapler S1 where stapling process, i.e., saddle stitching, is performed. The movable fence 210 is supported by a movable fence drive mechanism 210*a* and is movable from the position of a movable fence HP sensor 292 above in the drawing to the lowest position. As the movable range of the movable fence 210 on which the leading end of the sheet bundle abuts, a sufficient stroke is ensured to process the sheet bundle from a minimum size to a maximum size that the saddle stitch bookbinding device 2 can handle. As for the movable fence drive mechanism 210*a*, for example, a rack and pinion mechanism is used.

Between the upper bundle conveying guide plate 207 and the lower bundle conveying guide plate 208, i.e., near the mid portion of the middle folding conveying path 243, the folding plate 215, a folding roller pair 230, a delivery conveying path 244, and lower delivery rollers 231 are provided. The folding plate 215 is operable to reciprocate in the horizontal direction in the drawing and, in the operating direction of folding operation, the nip of the folding roller pair 230 is located and the delivery conveying path 244 is arranged in the extension thereof. The lower delivery rollers 231 are arranged at the most downstream of the delivery conveying path 244 and deliver the folded sheet bundle to the subsequent stage.

At the lower end of the upper bundle conveying guide plate 207, a sheet bundle detecting sensor 291 is provided to detect the leading end of the sheet bundle that is fed into the middle folding conveying path 243 and passes through the middle folding position. On the delivery conveying path 244, a folding portion passage sensor 293 is provided to detect the leading end of the middle-folded sheet bundle, thereby recognizing the passage of the sheet bundle.

In the saddle stitch bookbinding device 2 configured as schematically illustrated in FIG. 2, saddle stitching and middle folding operation is performed as illustrated in FIGS. 3 to 7 for explanation of the operation. More specifically, when the saddle stitching and middle folding operation is selected from an operation panel 105 of the image forming device 100 (see FIG. 19), the sheet bundle selected for the saddle stitching and middle folding operation is lead in the middle folding conveying path 243 side by the deviating operation of the branching claw 202 in the counter-clockwise direction. The branching claw 202 is driven by a solenoid. In place of the solenoid, the branching claw 202 may be motor driven.

Figure 3:
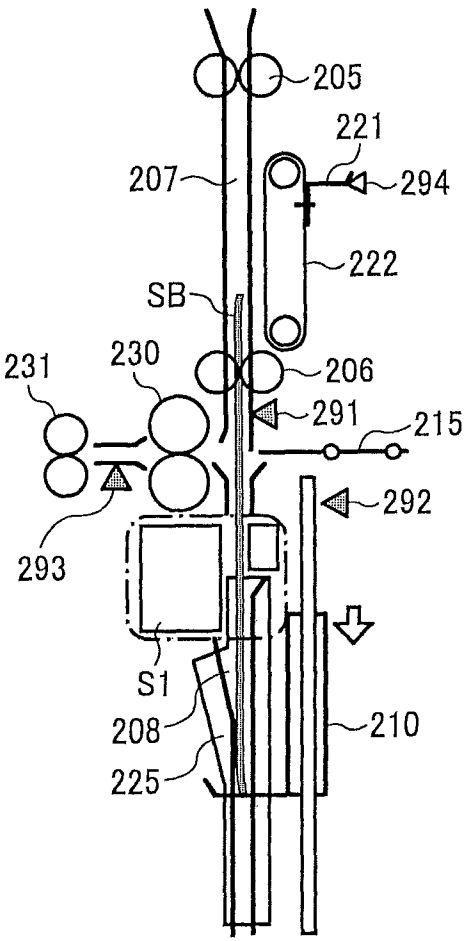

The sheet bundle SB fed into the middle folding conveying path 243 is conveyed downwards through the middle folding conveying path 243 by the entrance rollers 201 and the upper bundle conveying rollers 205 and, after its passage is confirmed by the sheet bundle detecting sensor 291, is conveyed by the lower bundle conveying rollers 206 to the position where the leading end of the sheet bundle SB abuts on the movable fence 210 as indicated in FIG. 3. In this case, the movable fence 210 waits at a stopping position that differs depending on sheet size information, i.e., size information of each sheet bundle SB in the conveying direction here, from a CPU 100-1 of the image forming device 100. In this case, as indicated in FIG. 3, the lower bundle conveying rollers 206 clamp the sheet bundle SB at the nip thereof, and the trailing end tapping claw 221 waits at the home position.

Figure 4:
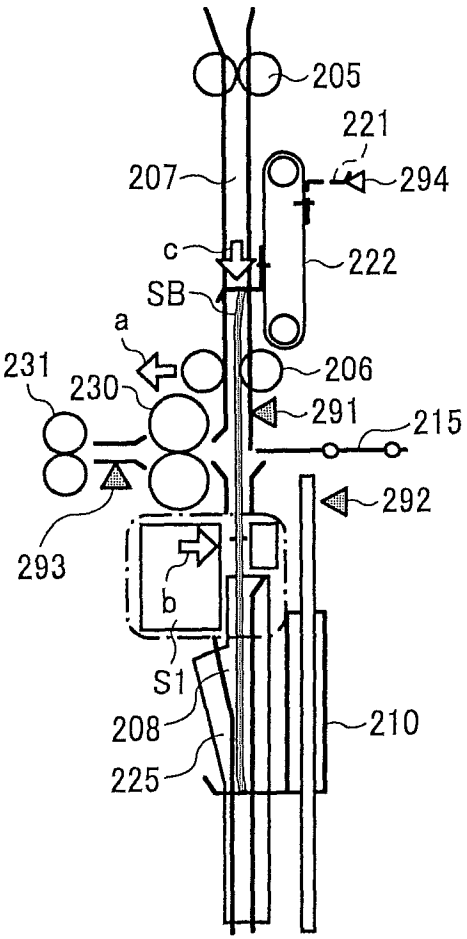
FIG. 4 is a schematic diagram for explaining the operation of the sheet post-processing device of when the sheet bundle is saddle stitched.

Under this condition, as indicated in FIG. 4, when the clamping pressure of the lower bundle conveying rollers 206 is released (in the direction of the arrow a) and the sheet bundle is stacked with its leading end abutting on the movable fence 210 and its trailing end being free, the trailing end tapping claw 221 is driven to tap the trailing end of the sheet bundle SB to perform final alignment in the conveying direction (in the arrow c direction).

Aligning operations are then performed by the saddle stitching jogger fences 225 in the width direction (direction orthogonal to the sheet conveying direction) and by the movable fence 210 and the trailing end tapping claw 221 in the conveying direction to complete the aligning operations in the width direction and the conveying direction of the sheet bundle SB. In this case, the pressing amount of the trailing end tapping claw 221 and the saddle stitching jogger fences 225 are changed to optimal values to align based on the information of sheet size, the information of number of sheets as sheet bundle configuration information constituting the sheet bundle, and the information of sheet bundle thickness. In addition to the information of size, number of sheets, and thickness, special paper information indicative of a special sheet is also used in a later-described mode setting.

When the sheet bundle is thick, the space in the conveying paths is reduced and only a single aligning operation is often not enough to align the bundle. Accordingly, in such a case, the amount of aligning operations is increased. Consequently, a better aligned state can be realized. Furthermore, the fact that the time it takes to sequentially place the sheet one on top of another on the upstream side increases as the number of sheets is increased, resulting in increased time until the subsequent sheet bundle SB is received. As a result, there is no time loss throughout the system even when the amount of aligning operations is increased, which efficiently realizes a better aligned state. This makes it possible to control the amount of aligning operations corresponding to the processing time on the upstream side.

The waiting position of the movable fence 210 is normally set at the position where the saddle stitching position of the sheet bundle SB faces the stapling position of the saddle stitching stapler S1. This is because when the aligning operation is performed at this position, the stapling process can be performed at the stacked position without moving the movable fence 210 to the saddle stitching position of the sheet bundle SB. At this waiting position, a stitcher of the saddle stitching stapler S1 is driven to the middle portion of the sheet bundle SB in the arrow b direction, and the stapling process is performed between a clincher and the stitcher to saddle stitch the sheet bundle SB.

The position of the movable fence 210 is determined by pulse control from the movable fence HP sensor 292, and the position of the trailing end tapping claw 221 is determined by pulse control from the trailing end tapping claw HP sensor 294. The position determining controls for the movable fence 210 and the trailing end tapping claw 221 are carried out by a CPU 2-1 of a control circuit in the saddle stitch bookbinding device 2 (see FIG. 19).

Figure 5:
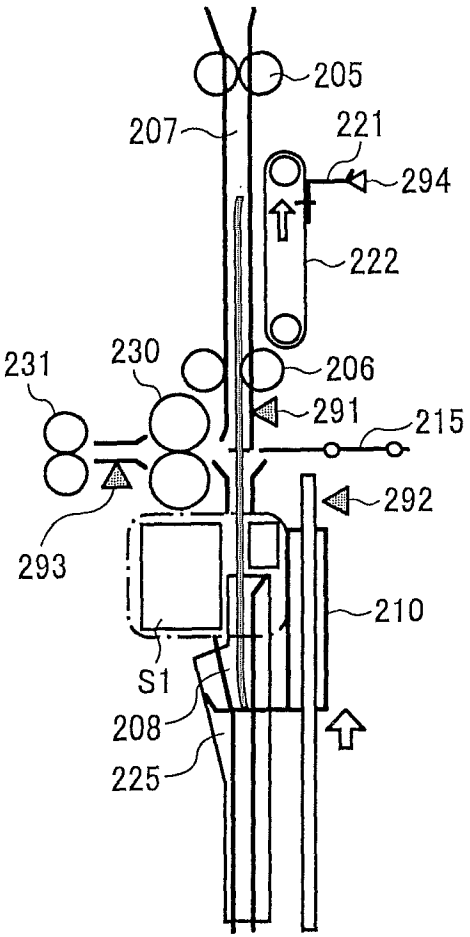
FIG. 5 is a schematic diagram for explaining the operation of the sheet post-processing device of when the movement to a middle folding position is completed.

The sheet bundle SB saddle stitched under the condition indicated in FIG. 4 is moved, as illustrated in FIG. 5, along with the movement of the movable fence 210 towards above, while the pressure of the lower bundle conveying rollers 206 is released, to the position where the saddle stitching position (center position of the sheet bundle SB in the conveying direction) faces the folding plate 215. This position is also controlled with reference to the detecting position of the movable fence HP sensor 292.

Figure 6:
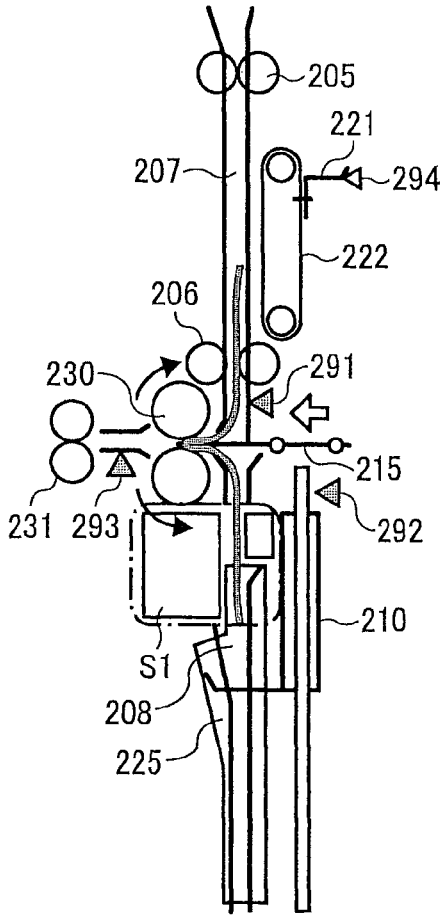
FIG. 6 is a schematic diagram for explaining the operation of the sheet post-processing device of when the middle folding position of the sheet bundle is folded.

When the sheet bundle SB reaches the position indicated in FIG. 5, the folding plate 215 moves towards the nip of the folding roller pair 230 as illustrated in FIG. 6, to abut on the sheet bundle SB near the position of staple of the stapled sheet bundle SB from an approximately orthogonal direction and to push it out towards the nip side. The sheet bundle SB is pushed by the folding plate 215, led to the nip of the folding roller pair 230, and wedged in the nip of the folding roller pair 230 that is pre-rotated. The folding roller pair 230 presses and conveys the sheet bundle SB wedged in the nip. By this pressure conveying operation, the sheet bundle SB is folded in the middle. FIG. 6 indicates the state of the leading end of the folding portion of the sheet bundle SB being clamped and pressed by the nip of the folding roller pair 230.

Figure 7:
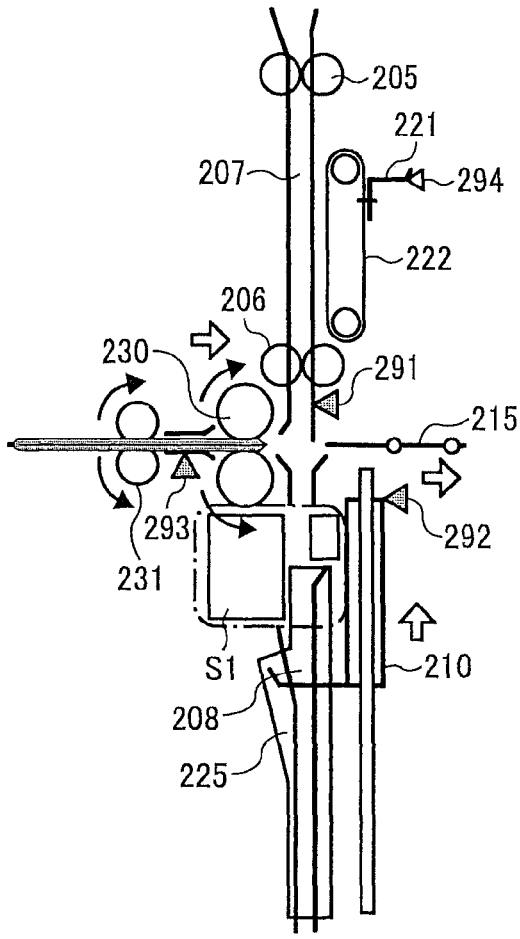
FIG. 7 is a schematic diagram for explaining the operation of the sheet post-processing device of when the sheet bundle is delivered after completion of the middle folding.

The sheet bundle SB double folded in the middle under the condition indicated in FIG. 6 is conveyed by the folding roller pair 230, as illustrated in FIG. 7, and is further clamped by the lower delivery rollers 231 and delivered to the subsequent stage. In this case, when the trailing end of the sheet bundle SB is detected by the folding portion passage sensor 293, the folding plate 215 and the movable fence 210 return to their respective home positions and the lower bundle conveying rollers 206 resume the pressing state preparing for the subsequent sheet bundle SB to be fed. If the subsequent job is of the same size and of the same number of sheets, the movable fence 210 may be moved to the position illustrated in FIG. 3 again to enter standby mode. These controls are also carried out by the CPU 2-1 of the control circuit.

Figure 8:
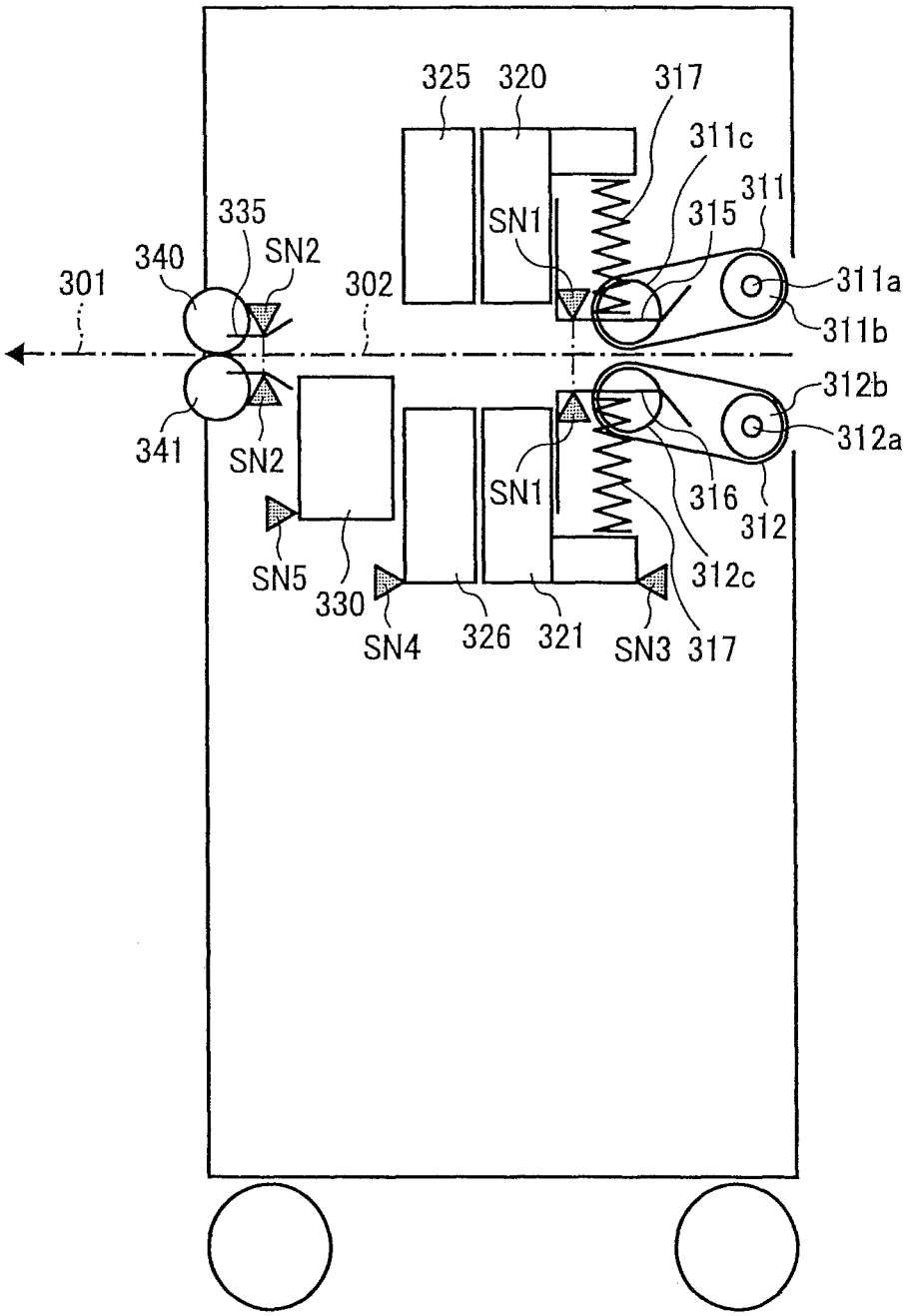
FIG. 8 is a front elevational view illustrating details of the spine forming device indicated in FIG. 1.

FIG. 8 is a front elevational view illustrating details of the spine forming device 3 indicated in FIG. 1. The spine forming device 3 is provided with, from the upstream side along a sheet bundle conveying path 302, a conveying unit, an auxiliary clamping unit, a pressure clamping unit, a stop unit, and a delivering unit. Through the description of the present specification, a booklet refers to a sheet bundle SB after being saddle stitched and folded in the middle and is differentiated from a simple sheet S.

The conveying unit is provided with upper and lower conveyor belts 311 and 312, the auxiliary clamping unit is provided with upper and lower conveying guide plates 315 and 316 and upper and lower auxiliary clamping plates 320 and 321, the pressure clamping unit is provided with upper and lower pressure clamping plates 325 and 326, the stop unit is provided with a stop plate 330, and the delivering unit is provided with delivery guide plates 335 and upper and lower delivery rollers 340 and 341 to constitute the spine forming device 3. These units indicated in FIG. 8 each have a conveying width equal to or wider than at least the width of the sheet bundle SB (width dimension in a direction orthogonal to the conveying direction) in the back of the paper (direction orthogonal to the plane of the drawing).

The upper conveyor belt 311 and the lower conveyor belt 312 are wound around drive pulleys 311*b* and 312*b* pivotally supported on rocking fulcrum points 311*a* and 312*a* and follower pulleys 311*c* and 312*c* located on the downstream side of the drive pulleys 311*b* and 312*b*, respectively, arranged to face each other with a conveying center 301 therebetween that is set as an extension of a line connecting the folding plate 215, the nip of the folding roller pair 230, and the nip of the lower delivery rollers 231, and are driven by a drive motor not indicated. The rocking fulcrum points 311*a* and 312*a* support the upper and the lower conveyor belts 311 and 312, respectively, such that the clearance between the follower pulleys 311*c* and 312*c* can accordingly follow the thickness of the sheet bundle SB.

Figure 9A:
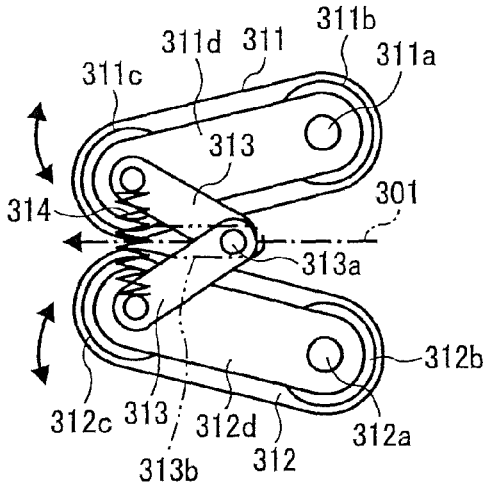
FIGS. 9A and 9B are schematic diagrams illustrating details of a conveying unit that conveys the sheet bundle indicated in FIG. 1, FIG. 9A depicting an initial state and FIG. 9B depicting a conveying state.
Figure 9B:
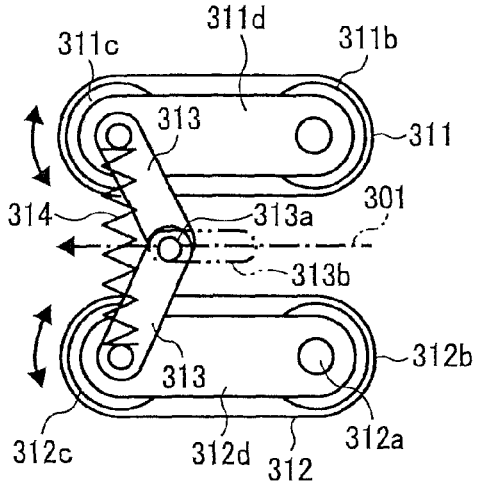

FIGS. 9A and 9B are schematic diagrams illustrating details of a conveying mechanism (conveying unit) that conveys the sheet bundle SB by the upper and the lower conveyor belts 311 and 312. FIG. 9A depicts an initial state, and FIG. 9B depicts a state of conveying the sheet bundle SB. As indicated in FIGS. 9A and 9B, the drive pulleys 311*b* and 312*b* and the follower pulleys 311*c* and 312*c* are coupled with supporting plates 311*d* and 312*d*, respectively, and the upper and the lower conveyor belts 311 and 312 are wound around the drive pulleys 311*b* and 312*b* and the follower pulleys 311*c* and 312*c*, respectively. Accordingly, the upper and the lower conveyor belts 311 and 312 rotate by obtaining driving force from the respective drive pulleys 311*b* and 312*b*.

Meanwhile, the rotational shafts of the follower pulleys 311*c* and 312*c* are connected with links 313 composed of two members rotatably coupled by a coupling shaft 313*a* and are elastically biased constantly by a pressure spring 314 in a direction to bring them closer to each other. The coupling shaft 313*a* is movable along a long hole 313*b* provided on a housing of the spine forming device 3 and extending in the conveying direction. Consequently, the coupling shaft 313*a* moves, as indicated in FIG. 9B, along the long hole 313*b* in response to the movement of the links 313 associated with open-close operation of the follower pulleys 311*c* and 312*c*. This makes it possible to change the clearance of the nip following the thickness of the sheet bundle SB and to exert a predetermined clamping pressure.

The coupling shaft 313*a* may be adapted, for example, to be movable along the long hole 313*b* by a rack and pinion mechanism so that the position of the coupling shaft 313*a* is moved by controlling a drive motor that drives the pinion. By arranging in such a manner, when the sheet bundle SB is thick, a conveying clearance for accepting the sheet bundle SB (clearance of the nip between the follower pulleys 311*c* and 312*c*) can be set, thereby alleviating the pressure exerted on the sheet bundle SB when the upper and the lower conveyor belts 311 and 312 on the follower pulley side run upon the leading end SB1 of the folding portion of the sheet bundle SB. Once the upper and the lower conveyor belts 311 and 312 operate on the sheet bundle SB, stopping supply of power to the drive motor makes the follower pulleys 311*c* and 312*c* clamp the sheet bundle SB only with the elastic bias of the pressure spring 314 to exert conveying power.

Figure 10A:
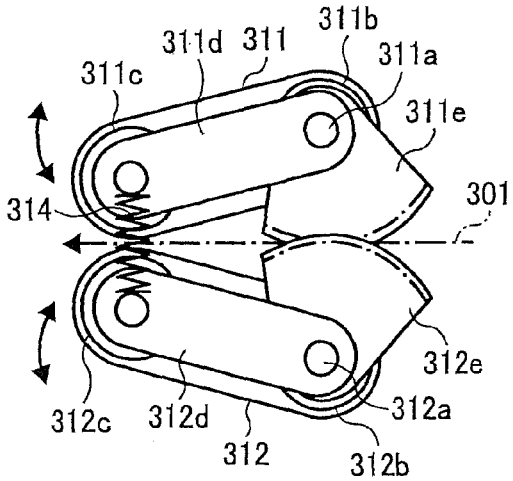
FIGS. 10A and 10B are schematic diagrams illustrating details of another example of the conveying unit that conveys the sheet bundle indicated in FIG. 1, FIG. 10A depicting an initial state and FIG. 10B depicting a conveying state.
Figure 10B:
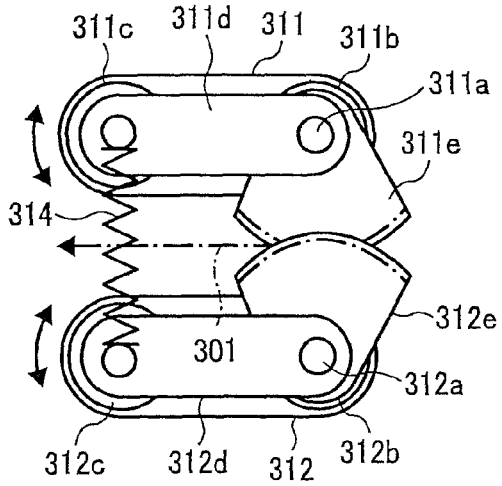

FIGS. 10A and 10B depict an example of a structure, in place of the link 313 indicated in FIGS. 9A and 9B, provided with sector gears 311*e* and 312*e* on the respective rocking fulcrum points 311*a* and 312*a*. The sector gears 311*e* and 312*e* are meshed with each other such that the follower pulleys 311*c* and 312*c* are symmetrically separated with respect to the conveying center 301. FIG. 10A depicts an initial state, while FIG. 10B depicts a state of conveying the sheet bundle SB. In this case, adapting one of the sector gears 311*e* and 312*e* to be driven by a drive motor including a speed reduction mechanism allows for setting the conveying clearance for accepting the sheet bundle SB, similarly to the example illustrated in FIGS. 9A and 9B.

As illustrated in FIG. 8, near a conveying nip formed by the upper and the lower conveyor belts 311 and 312 on the follower pulleys 311*c* and 312*c* side, the upper and the lower conveying guide plates 315 and 316 are disposed symmetrically with the conveying center 301 therebetween. The upper and the lower conveying guide plates 315 and 316 are each formed of a flat plane from the vicinity of the conveying nip to the respective transferring portion of the upper and the lower auxiliary clamping plates 320 and 321, serving as a conveying plane. The upper and the lower conveying guide plates 315 and 316 are mounted on the upper and the lower auxiliary clamping plates 320 and 321, respectively, so as to be able to move in a vertical direction and to exert pressure (elasticity) towards the conveying center 301 by pressure springs 317. The upper and the lower auxiliary clamping plates 320 and 321 are also movably guided and supported by the housing not indicated to move in the vertical direction. It is possible to omit the upper and the lower conveying guide plates 315 and 316, and instead use the shape of the planes of the upper and the lower auxiliary clamping plates 320 and 321 facing the sheet bundle SB as the upper and the lower conveying guide plates 315 and 316.

The auxiliary clamping unit provided with the upper and the lower auxiliary clamping plates 320 and 321, similarly to an approaching and separating mechanism constituted by the upper and the lower conveyor belts 311 and 312 in the conveying unit, moves symmetrically to approach to and to separate from the conveying center 301. The approaching and separating mechanism provided to the auxiliary clamping unit can be configured using a linking mechanism or a coupling mechanism with racks and sector gears explained for the conveying unit.

The reference position for detecting a displacement position is determined by a detection output of an auxiliary clamping plate HP sensor SN3. The fact that a driving mechanism not indicated and the upper and the lower auxiliary clamping plates 320 and 321 are coupled via a spring or the like, similarly to the pressure spring 314 in the conveying unit, prevents the driving mechanism from being damaged by overloading when clamping the sheet bundle SB. Each of the pressure clamping planes of the upper and the lower auxiliary clamping plates 320 and 321 that clamps the sheet bundle SB is in a flat plane in parallel with respect to the conveying direction, i.e., the conveying center 301.

The pressure clamping unit is provided with the upper and the lower pressure clamping plates 325 and 326. The upper and the lower pressure clamping plates 325 and 326, similarly to the approaching and separating mechanism by the upper and the lower conveyor belts 311 and 312 in the conveying unit, moves symmetrically to approach to and to separate from the conveying center 301. The approaching and separating mechanism provided to the pressure clamping unit can be configured using a linking mechanism or a coupling mechanism with racks and sector gears explained for the conveying unit. As for the upper and the lower pressure clamping plates 325 and 326, the reference position for detecting a displacement position is determined by a detection output of a pressure clamping plate HP sensor SN4. The operation and other structures are similar to those of the auxiliary clamping plates 320 and 321 and thus, their explanations are omitted. While the drive motor in the conveying unit is not essential, the drive motor or other driving sources are essential in the auxiliary clamping unit and the pressure clamping unit. The auxiliary clamping unit and the pressure clamping unit are enabled to move to a clamping position of the sheet bundle SB and a retracted position by the driving force of the drive motor or the other driving sources. Each of the pressure clamping planes of the upper and the lower pressure clamping plates 325 and 326 that clamps the sheet bundle SB, as similar to those of the auxiliary clamping plates 320 and 321, is in a flat plane in parallel with respect to the conveying direction, i.e., the conveying center 301.

The stop unit is provided downstream of the pressure clamping unit. The stop unit is composed of the stop plate 330 and a moving mechanism not indicated that lifts and lowers the stop plate 330. The stop plate 330 advances and retracts with respect to the conveying path 302, and the reference position for detecting its displacement position is determined by a detection output of a stop plate HP sensor SN5. The top surface of the stop plate 330 in the retracted position from the conveying path 302 serves as a conveying guide for the sheet bundle SB. Accordingly, the top surface is formed as a flat plane in parallel with the sheet conveying direction, i.e., the conveying center 301. The moving mechanism can be configured, for example, with a rack and pinion mechanism, not indicated, provided on both sides of the stop plate 330 (on the front side and the rear side of the device) and a drive motor that drives the pinion. With the structure thus configured, the stop plate 330 can be lifted and lowered by the drive of the drive motor and further, be positioned to a predetermined position.

Figure 18:
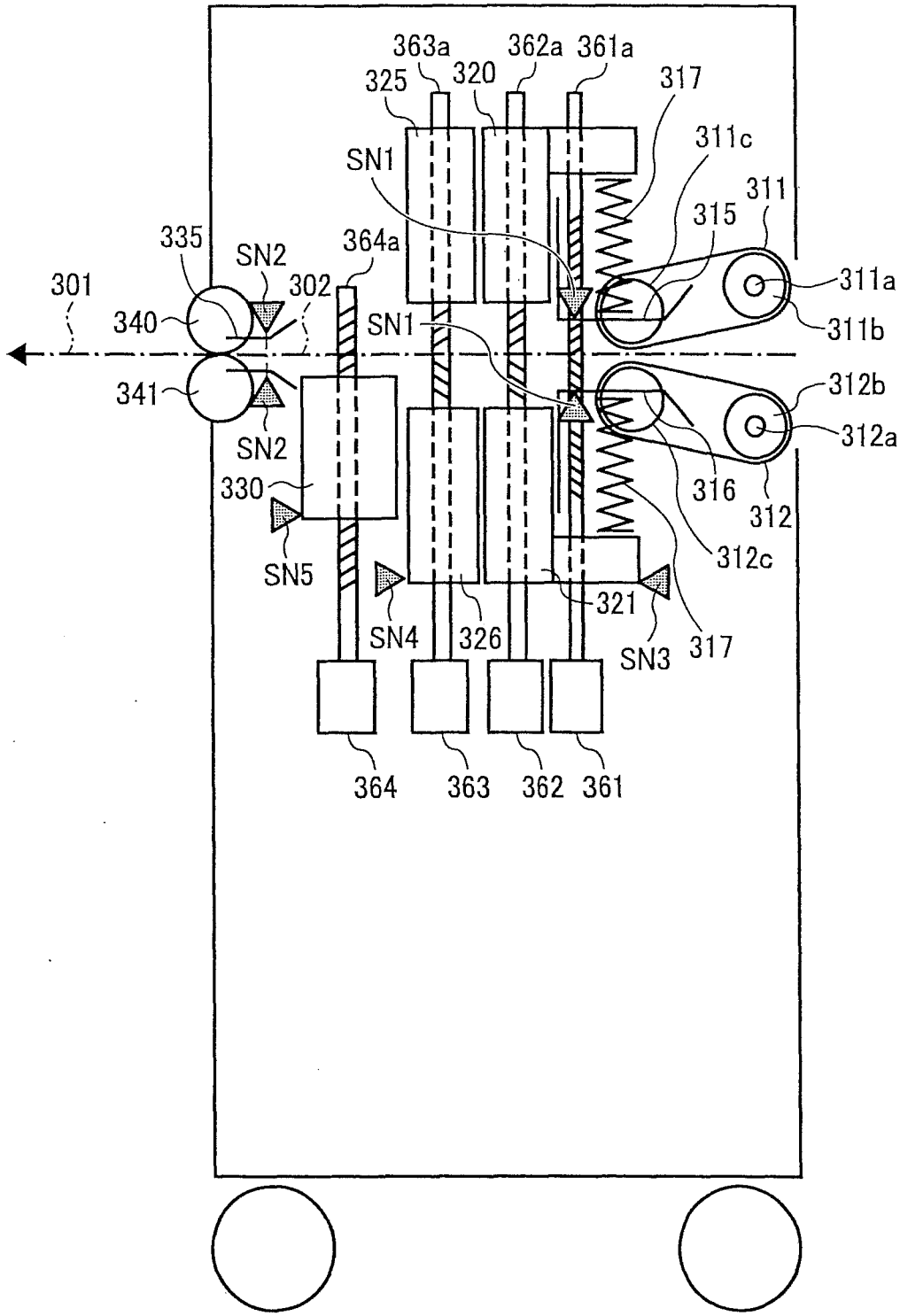
FIG. 18 is a schematic illustrating an example of a drive mechanism that lifts and lowers conveying guide plates, the auxiliary clamping plates, the pressure clamping plates, and the stop plate driven by threaded drive.

The upper and the lower conveying guide plates 315 and 316, the auxiliary clamping plates 320 and 321, the pressure clamping plates 325 and 326, and the stop plate 330 can be screw driven. FIG. 18 is a schematic diagram illustrating an example of the drive mechanism configured with drive motors 361, 362, 363, and 364, and threaded shafts 361*a*, 362*a*, 363*a*, and 364*a* coaxially provided with drive shafts of the respective drive motors 361, 362, 363, and 364. The drive motors 361 to 364 each have a speed reduction mechanism, and the threaded shafts 361*a*, 362*a*, and 363*a* that drive the conveying guide plates 315 and 316, the auxiliary clamping plates 320 and 321, and the pressure clamping plates 325 and 326 are threaded in opposite directions bordered by the center thereof (the conveying center 301). The auxiliary clamping plates 320 and 321 and the pressure clamping plates 325 and 326 are mounted on the respective threaded portions of the oppositely threaded shafts 361*a*, 362*a*, and 363*a* and are symmetrically moved in the approaching direction and the separating direction in response to the rotational direction of the respective drive motors 361 to 364. The axis of symmetry is the conveying center 301. The stop plate 330 is also driven by the threaded shaft 364*a* coaxial with the drive motor 364 to perform lifting and lowering operations.

The threaded shafts 361*a*, 362*a*, 363*a*, and 364*a* are provided on the back side of the spine forming device 3 outside the range of sheet bundle passage, and guiding rods not indicated are provided on the front side out of the range of sheet bundle passage. Accordingly, the upper and the lower conveying guide plates 315 and 316, the auxiliary clamping plates 320 and 321, the pressure clamping plates 325 and 326, and the stop plate 330 can perform lifting and lowering operations in parallel along the threaded shafts 361*a*, 362*a*, 363*a*, and 364*a* that are screwed with the respective plates and the guiding rods that slidably guide the respective plates.

The delivering unit is provided downstream of the stop unit. The delivering unit is configured with the delivery guide plates 335 and the upper and the lower delivery rollers 340 and 341, and the spine formed sheet bundle SB is delivered out of the device by the delivery rollers 340 and 341. The delivery rollers 340 and 341 have a later-described roller separating mechanism that remains in a separated state when the back-face portion passes and that presses the booklet to be delivered after the flatly formed back-face portion passes. The stopping position in spine forming process and the timing of separating and pressing of the delivery rollers 340 and 341 are controlled based on the conveying amount from the position where the leading end of the sheet bundle is detected by a conveying sensor SN1.

The conveying amount is set to be a sum of a distance of the leading end of the sheet bundle SB to abut on the stop plate 330 and a distance necessary to cause a bulge required for forming the leading end of the sheet bundle SB. The conveying amount is determined by managing pulses or controlling an encoder of the drive motor. On an immediate upstream side of the lower delivery roller 341, a delivery sensor SN2 is provided to detect passage of the sheet bundle SB through the conveying path 302.

FIGS. 11 to 17 are schematics for explaining the spine forming operation of the spine forming device 3 that forms the folding portion of the sheet bundle SB in a flat shape and flattens the front cover and the rear cover adjacent to the folding portion. With reference to these drawings, the operation of flattening the leading end of the folding portion of the sheet bundle SB, in other words, the back-face portion of the sheet bundle SB, will be explained below.

In response to a sheet bundle detecting signal from an entrance sensor of the spine forming device 3 not indicated or from the folding portion passage sensor 293 of the saddle stitch bookbinding device 2, the respective units of the spine forming device 3 prepare for receiving sheets. In the sheet receiving preparation, the upper conveyor belt 311 and the lower conveyor belt 312 start rotating, the upper auxiliary clamping plate 320 and the lower auxiliary clamping plate 321 once move to the detecting position of the auxiliary clamping plate HP sensor SN3, i.e., its home position, and then move towards the conveying center 301 to make a predetermined conveying gap (separating distance) and stop there. The upper pressure clamping plate 325 and the lower pressure clamping plate 326 also move to the detecting position of the pressure clamping plate HP sensor SN4 (home position) and thereafter, move towards the conveying center 301 to make a predetermined conveying gap (separating distance) and stop there. Because the upper and the lower auxiliary clamping plates 320 and 321 and the upper and the lower pressure clamping plates 325 and 326 are arranged symmetrically and operate symmetrically with respect to the conveying center 301, when the respective home positions of one side are detected, those of the other side are assumed to be in the same state. Accordingly, the HP sensors SN3 and SN4 are provided only on one side. The stop plate 330 moves to the detecting position of the stop plate HP sensor SN5 (home position) and then moves towards the conveying center 301 for a predetermined distance and stops at the position blocking the conveying path 302. This condition corresponds to the condition illustrated in FIG. 11 without the sheet bundle SB being fed.

Figure 11:
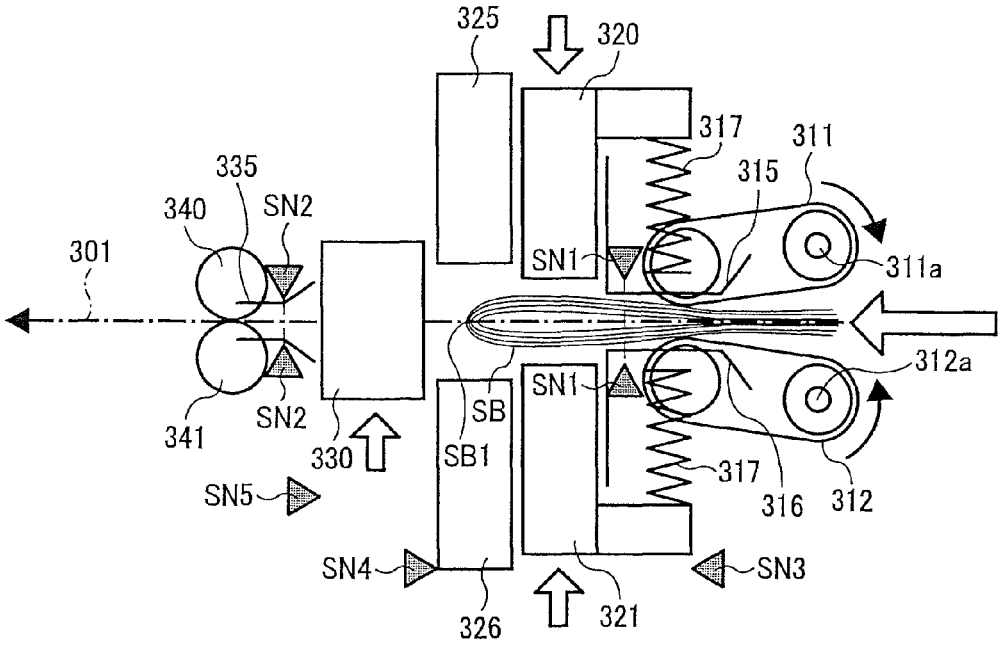
Figure 12:
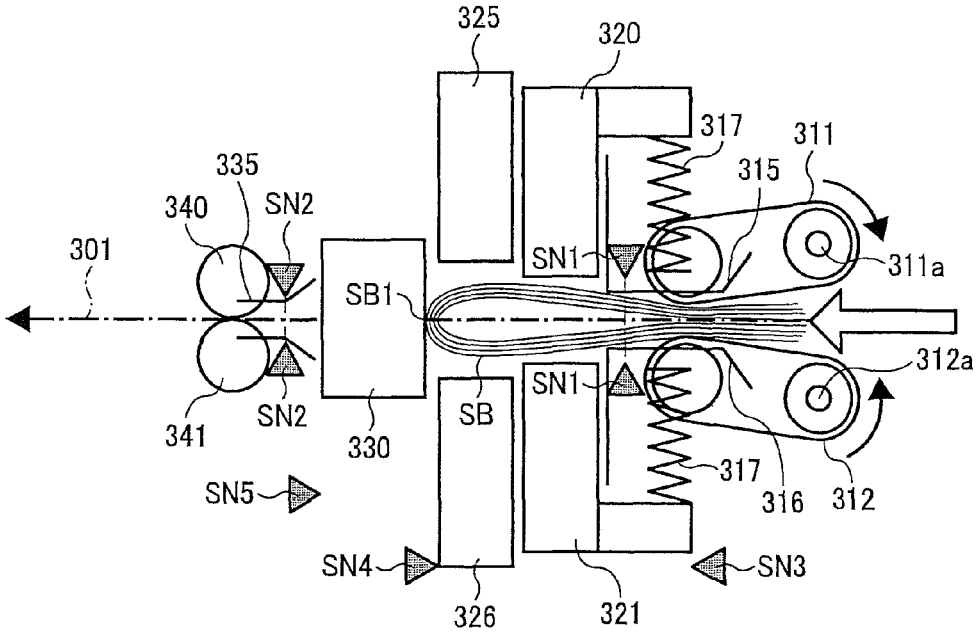
FIG. 12 is a schematic diagram for explaining the spine forming operation of the spine forming device of when the leading end of the sheet bundle abuts on a stop plate.

Under this condition, the sheet bundle SB delivered from the lower delivery rollers 231 of the saddle stitch bookbinding device 2 and fed to the spine forming device 3, as illustrated in FIG. 11, is fed into the device by the upper conveyor belt 311 and the lower conveyor belts 312 that are already rotating. The leading end SB1 of the folding portion of the sheet bundle SB is detected by the conveying sensor SN1, and the sheet bundle SB is stopped after being conveyed for the predetermined distance that is the addition of the distance required for the leading end SB1 of the folding portion to abut on the stop plate 330 and the distance to cause a bulge SB2 required for forming the leading end SB1 of the folding portion, as illustrated in FIG. 12. The predetermined distance is set corresponding to the sheet bundle SB information such as paper thickness, size, binding, number of sheets, and special paper.

Figure 13:
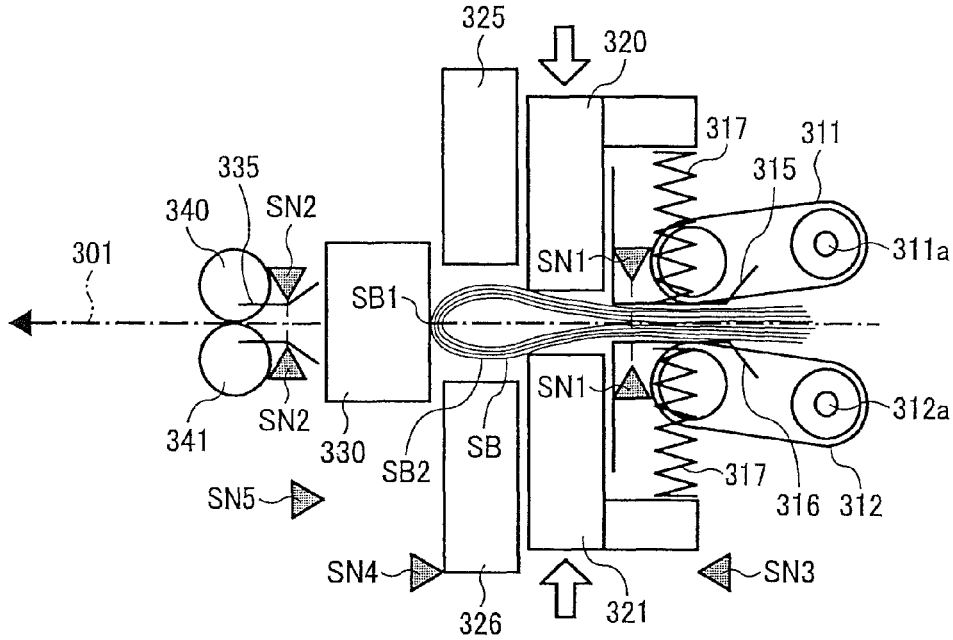
FIG. 13 is a schematic diagram for explaining the spine forming operation of the spine forming device of when the sheet bundle is clamped and pressure is applied thereto by auxiliary clamping plates.
Figure 14:
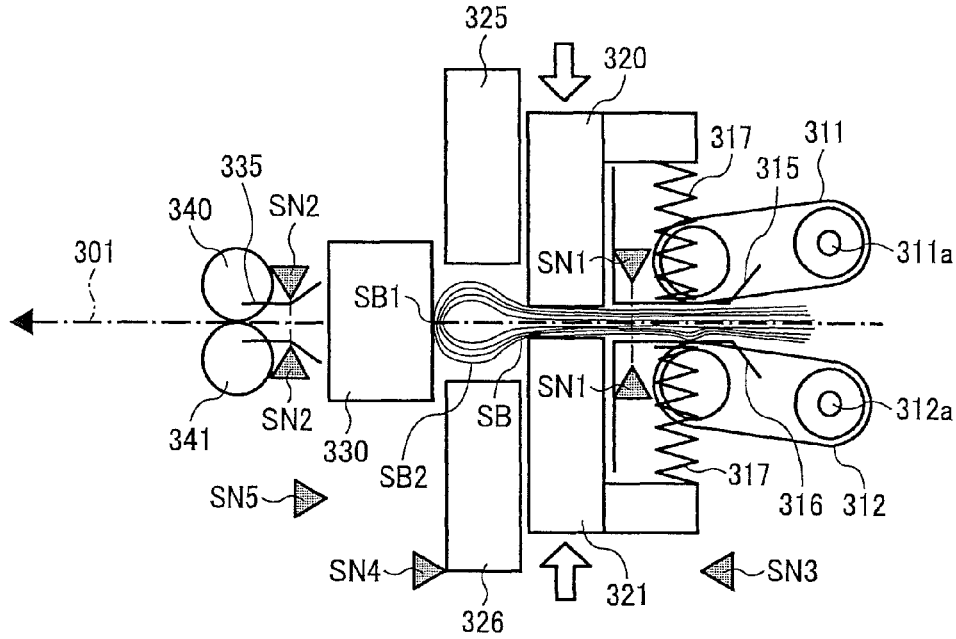
FIG. 14 is a schematic diagram for explaining the spine forming operation of the spine forming device of when the auxiliary clamping plates complete clamping and applying the pressure to the sheet bundle.

When the sheet bundle SB is stopped under the condition illustrated in FIG. 12, the upper auxiliary clamping plate 320 and the lower auxiliary clamping plate 321 start moving towards the conveying center 301 as illustrated in FIG. 13, and the upper conveying guide plate 315 and the lower conveying guide plate 316 clamp the sheet bundle SB first in a pressed state by the elastic force of the pressure springs 317. When a given pressure is applied by the upper conveying guide plate 315 and the lower conveying guide plate 316, the upper auxiliary clamping plate 320 and the lower auxiliary clamping plate 321 move further towards the conveying center 301, and the upper auxiliary clamping plate 320 and the lower auxiliary clamping plate 321 further clamp the sheet bundle SB on the downstream side towards the leading end SB1 of the folding portion. When a predetermined pressure is reached, the movement of the upper auxiliary clamping plate 320 and the lower auxiliary clamping plate 321 is stopped, and the sheet bundle SB is held in a pressed state at the predetermined pressure as illustrated in FIG. 14. Accordingly, the leading end SB1 of the folding portion of the sheet bundle SB abuts on the stop plate 330 and the bulge SB2 larger than the bulge SB2 illustrated in FIG. 13 appears on the downstream side towards the leading end SB1 of the folding portion.

Figure 15:
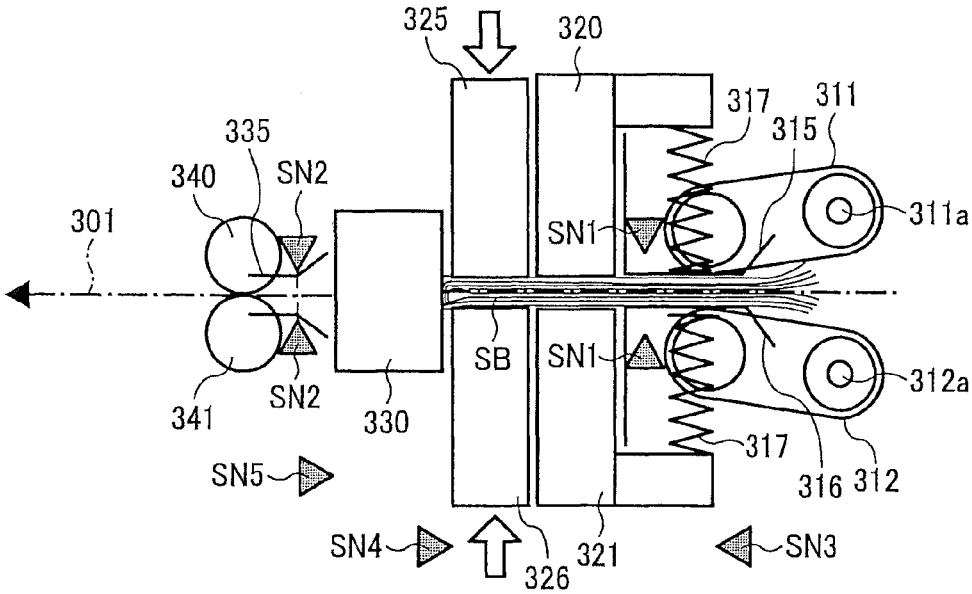
FIG. 15 is a schematic diagram for explaining the spine forming operation of the spine forming device of when pressure clamping plates complete clamping and applying pressure to the sheet bundle.

From the pressure clamping state by the upper and the lower auxiliary clamping plates 320 and 321 as illustrated in FIG. 14, the upper pressure clamping plate 325 and the lower pressure clamping plate 326 then start moving towards the conveying center 301 as illustrated in FIG. 15. Along with the movement, the bulge SB2 converged to the leading end SB1 of the folding portion is gradually pressed and deformed following the shape of the space formed by the upper pressure clamping plate 325, the lower pressure clamping plate 326, and the stop plate 330. When the pressing is completed, the leading end SB1 of the folding portion of the sheet bundle SB is flattened copying the shape of the stop plate 330, and a flattened back face (spine) is formed on the sheet bundle SB. Furthermore, a portion of the front cover SB3 and a portion of the rear cover SB4 near the folding portion are also formed to be flat. Consequently, a booklet can be provided with a square spine formed at the saddle stitched middle folding portion of the sheet bundle SB (see FIG. 17).

Figure 16:
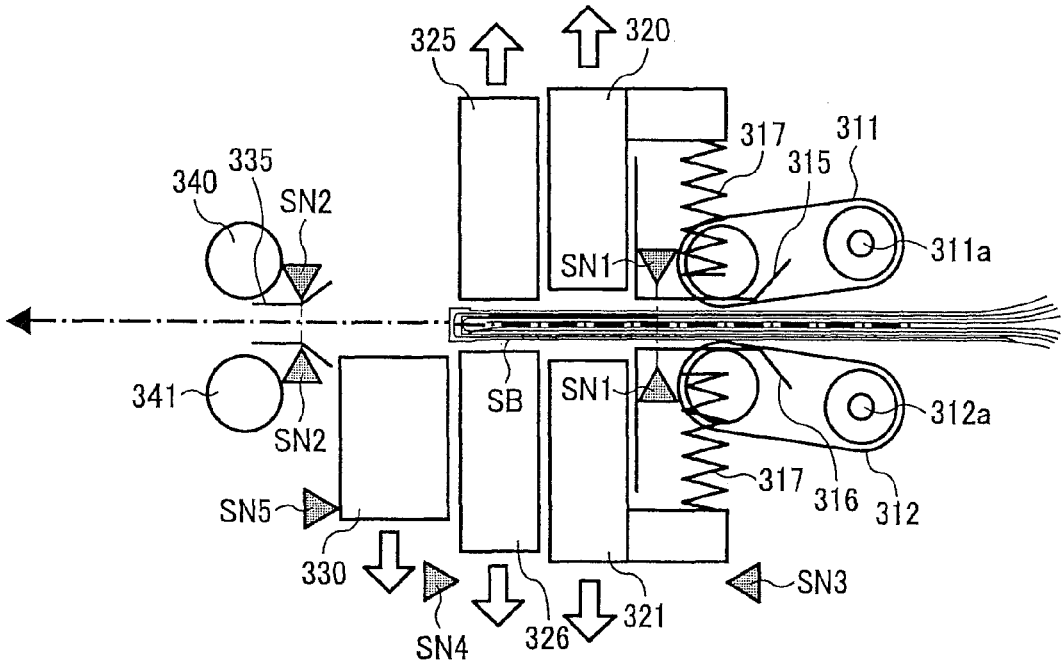
FIG. 16 is a schematic diagram for explaining the spine forming operation of the spine forming device of when the pressed state is released after completion of the spine forming operation.
Figure 17:
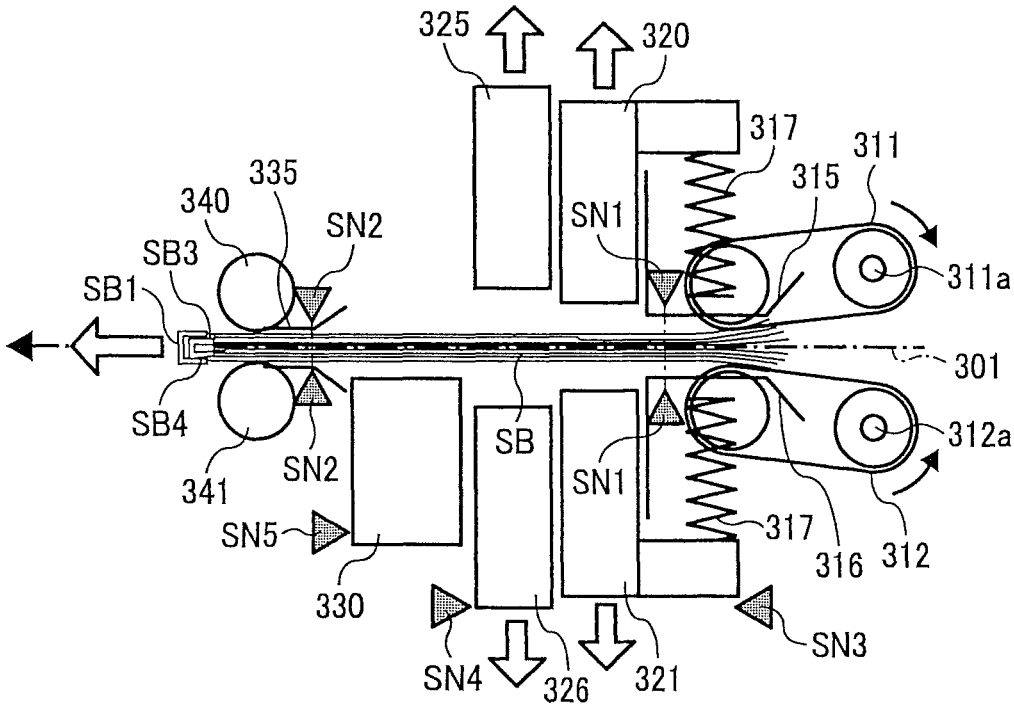
FIG. 17 is a schematic for explaining the spine forming operation of the spine forming device of when the sheet bundle is taken out after the completion of the spine forming operation.

Thereafter, as illustrated in FIG. 16, the upper auxiliary clamping plate 320, the lower auxiliary clamping plate 321, the upper pressure clamping plate 325, and the lower pressure clamping plate 326 separate from the sheet bundle SB and stop at their predetermined positions. The stop plate 330 also moves towards its home position and stops at the position where the top surface of the stop plate can serve as a conveying guide for the sheet bundle SB. After the upper and the lower auxiliary clamping plates 320 and 321, the upper and the lower pressure clamping plates 325 and 326, and the stop plate 330 move to their standby positions as indicated in FIG. 16, the upper and the lower delivery rollers 340 and 341 separate from each other. As illustrated in FIG. 17, after the leading end SB1 of the booklet passes the delivery rollers 340 and 341, the both rollers contact and press the booklet, and the upper conveyor belt 311, the lower conveyor belt 312, the upper delivery roller 340, and the lower delivery roller 341 start to rotate so as to deliver the booklet to outside of the device. That completes a series of operation. The timing of the upper and the lower delivery rollers 340 and 341 to contact and press the booklet is set based on the detection information of the delivery sensor SN2.

The upper and the lower conveyor belts 311 and 312 and the upper and the lower delivery rollers 340 and 341 that are rotating stop in a predetermined timing based on the detection information of the delivery sensor SN2. In time with that, the other movable units move to their respective home positions. When the sheet bundle SB is continuously conveyed from the saddle stitch bookbinding device 2, the timings to stop rotation of the upper and the lower conveyor belts 311 and 312 and the upper and the lower delivery rollers 340 and 341 are changed depending on the conveying condition of the subsequent sheet bundle SB. Further, the other movable units are not necessarily required to return to their home positions every time, and the receiving position of the sheet bundle SB may also be moved corresponding to the conveying condition and the sheet bundle SB information. These controls are carried out by a CPU 3-1 of a control circuit in the spine forming device 3.

Figures 19, 19A:
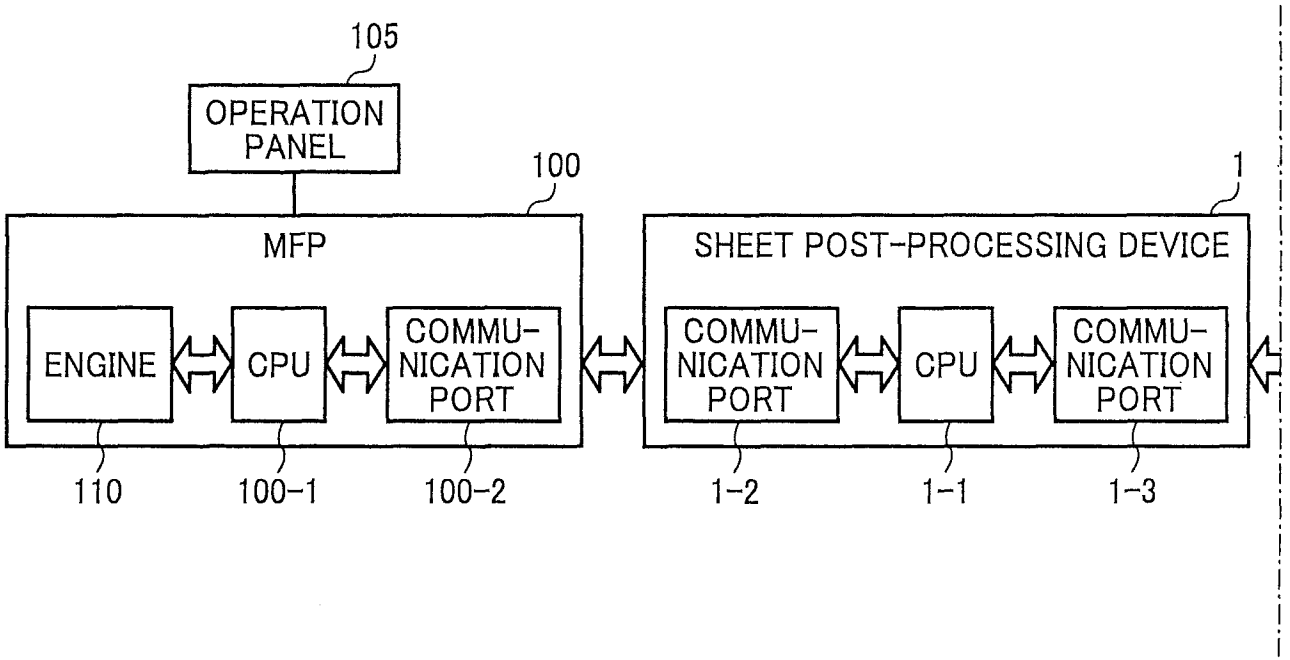
FIG. 19 is a block diagram schematically illustrating an online control structure of a bookbinding system including the sheet processing system.
Figure 19B:
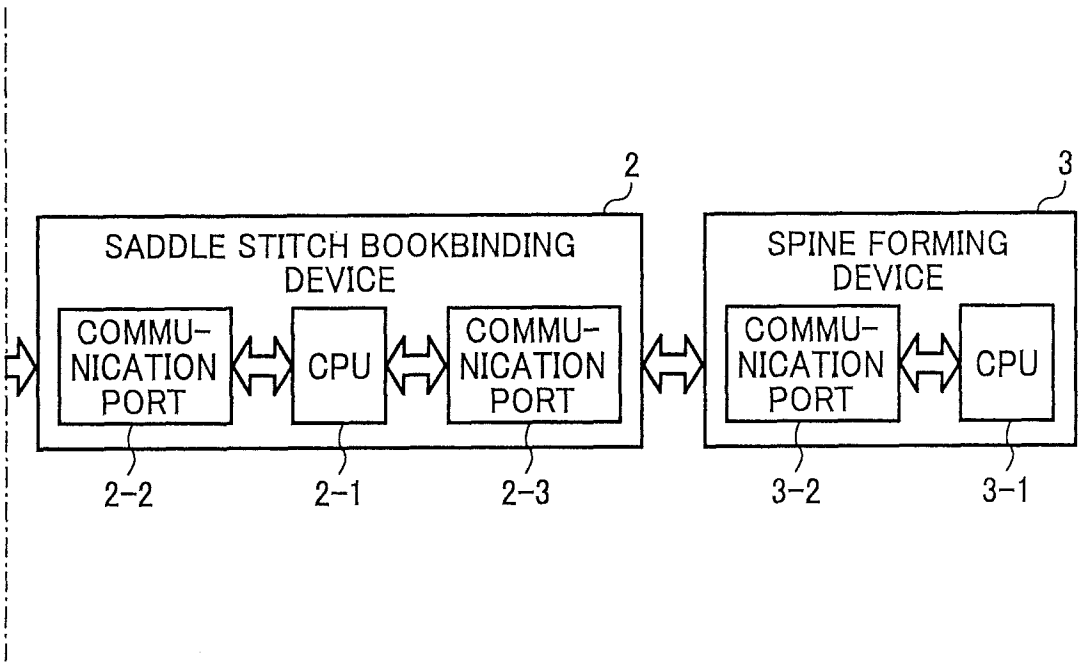

The control circuits are configured online as illustrated in FIG. 19. FIG. 19 is a block diagram schematically illustrating the configuration of online control for the bookbinding system including the sheet processing system. More specifically, the image forming device (MFP) 100 provided with an engine 110 is connected with the sheet post-processing device 1, and the sheet post-processing device 1 is connected with the saddle stitch processing device 2, and the saddle stitch processing device 2 is connected with the spine forming device 3. The image forming device 100 is provided with the CPU 100-1 and a communication port 100-2. The sheet post-processing device 1 is provided with a CPU 1-1, a communication port 1-2, and a communication port 1-3. The saddle stitch processing device 2 is provided with the CPU 2-1, a communication port 2-2, and a communication port 2-3. The spine forming device 3 is provided with the CPU 3-1 and a communication port 3-2. The MFP 100 and the sheet post-processing device 1 can communicate with each other via the communication port 100-2 and the communication port 1-2, the sheet post-processing device 1 and the saddle stitch processing device 2 can communicate with each other via the communication port 1-3 and the communication port 2-2, and the saddle stitch processing device 2 and the spine forming device 3 can communicate with each other via the communication port 2-3 and the communication port 3-2. The operation panel 105 is provided on the image forming device 100. The CPU 100-1 of the image forming device 100 controls the display and input operation of the operation panel 105 to function as a user interface.

The CPU 100-1 installed in the image forming device 100, the CPU 1-1 installed in the sheet post-processing device 1, the CPU 2-1 installed in the saddle stitch processing device 2, and the CPU-3-1 installed in the spine forming device 3 read out program codes stored in respective ROMs installed in the image forming device 100, the sheet post-processing device 1, the saddle stitch processing device 2, and the spine forming device 3, deploy the codes to respective RAMs, and use the RAMs as working areas to execute programs described in the program codes. Consequently, the foregoing or subsequently described various controls and processes are carried out. These devices are serially connected in a line (in-line) through the communication port 100-2, the communication port 1-2, the communication port 1-3, the communication port 2-2, the communication port 2-3, and the communication port 3-2. When processing online, communication is performed with the CPU 100-1 of the image forming device 100, and the CPU 1-1, the CPU 2-1, and the CPU 3-1 operate under the control of the CPU 100-1 based on the control information output from the CPU 100-1 of the image forming device 100.

In the present embodiment, in-line means that the processes from image forming to sheet processing, saddle stitching or spine forming of a booklet are all processed in a single continuous flow of a sheet. The control information includes the sheet bundle SB information, and the sheet bundle SB information includes the information of at least number of sheets and paper thickness, from out of the information of number of sheets, paper thickness, size, or special paper. When the special paper information is included, the information indicative of OHP transparency, label paper, coated paper, irregular shaped paper with fold, or perforated paper is added for determining the type of the special paper.

The CPU 100-1 of the image forming device 100, the CPU 1-1 of the sheet post-processing device 1, the CPU 2-1 of the saddle stitching device 2, the CPU 3-1 of the spine forming device 3, storage devices including the ROMs and the RAMs not indicated, the operation panel 105 of the MFP 100, and the like function as resources when the computer performs the spine forming process.

Figure 20A:
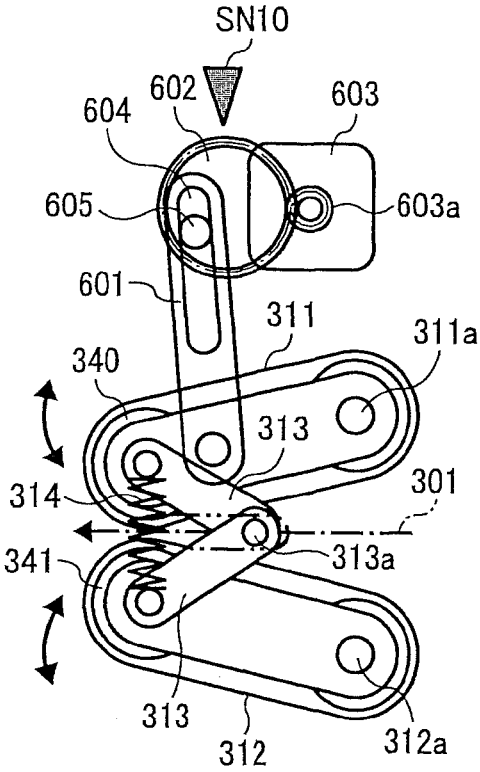
FIGS. 20A and 20B are schematic diagrams illustrating details of a separating mechanism of an upper delivery roller and a lower delivery roller, FIG. 20A depicting an initial state and FIG. 20B depicting a conveying state.
Figure 20B:
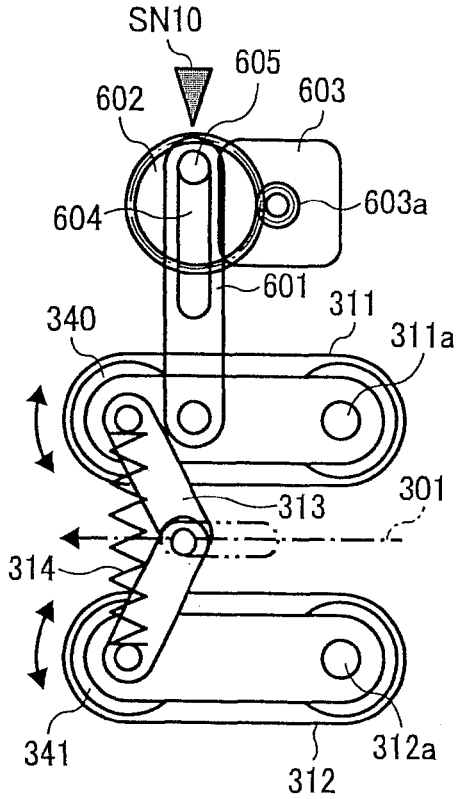

FIGS. 20A and 20B are schematics illustrating details of a separating mechanism of the upper delivery roller 340 and the lower delivery roller 341. The basic structure of the separating mechanism is the same as that illustrated in FIGS. 9A and 9B, and is configured to separate symmetrically with respect to the conveying center of the sheet. FIG. 20A depicts an initial state, and FIG. 20B depicts a state of conveying the sheet bundle SB. The separating mechanism operates with a link 601 rotatably fixed to one end of the upper delivery roller 340 and a crank 602 provided with a pin 605 that fits to a long hole 604 formed on the other end side of the link 601. The outer circumference of the crank 602 is formed with gear teeth (follower gear) 602*a*, and the crank 602 is driven by a drive gear 603*a* provided on the output shaft of an open-close drive motor 603, thereby driving the opening and closing of the delivery rollers 340 and 341. A separating operation is carried out by the crank 602 driving the link 601 rotatably fixed to one end of the upper delivery roller 340, and an approaching operation is carried out by the elastic bias of the pressure spring 314.

The open-close drive motor 603 is a stepping motor and rotates to a pressing position being pulse controlled based on the home position of the crank 602 detected by a home position sensor SN10. In the example illustrated in FIGS. 20A and 20B, while the home position is set at the position where the upper delivery roller 340 and the lower delivery roller 341 separate most, the home position may obviously be set at the pressing position. In the present embodiment, although it is configured to separate symmetrically with respect to the conveying center of the sheet, a structure of one of the delivery rollers being fixed and only the other delivery roller being separated may be used.

In FIGS. 20A and 20B, the same constituents as those illustrated in FIGS. 9A and 9B have the same reference numerals and marks, and their redundant explanations are omitted.

Figure 21A:
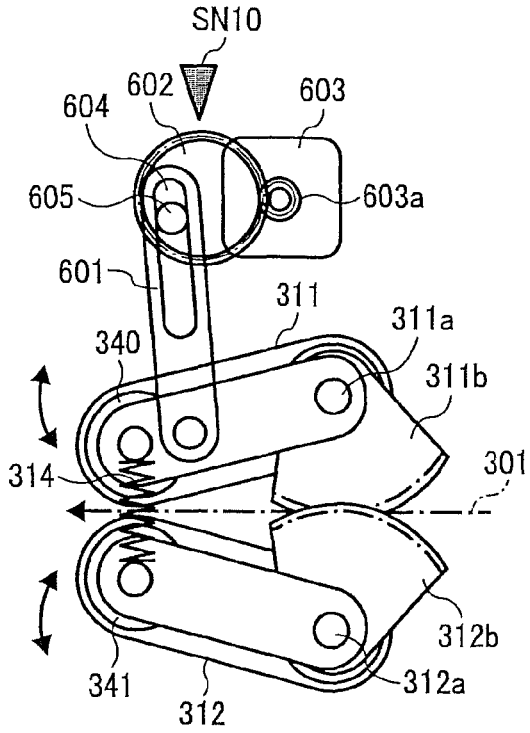
FIGS. 21A and 21B are schematic diagrams illustrating details of another example of the separating mechanism of the upper delivery roller and the lower delivery roller, FIG. 21A depicting an initial state and FIG. 21B depicting a conveying state.
Figure 21B:
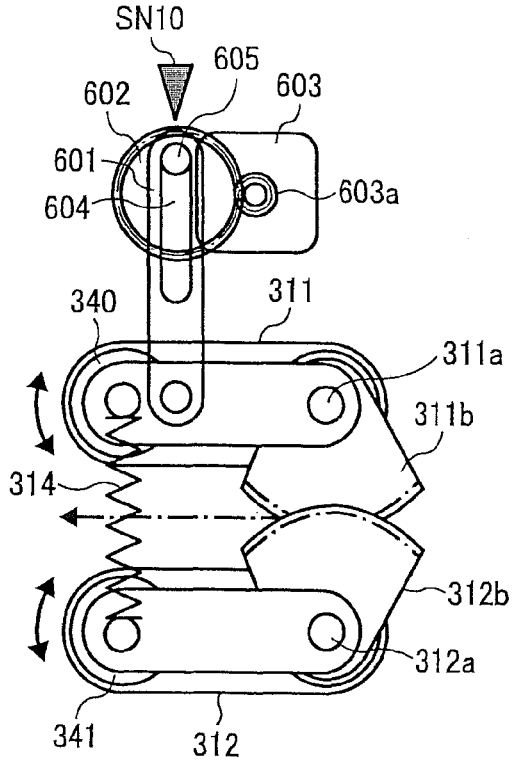

FIGS. 21A and 21B are schematics illustrating details of another example of the separating mechanism of the upper delivery roller 340 and the lower delivery roller 341. The basic structure of this example is the same as that illustrated in FIGS. 10A and 10B, and this example is configured, in place of the link 313 indicated in FIGS. 9A and 9B, with the sector gears 311*e* and 312*e* provided on the rocking shafts 311*a* and 312*a* being meshed with each other such that the follower pulleys are symmetrically separated with respect to the conveying center 301. FIG. 21A depicts an initial state, and FIG. 21B depicts a state of conveying the sheet bundle SB. In this example, the separating mechanism operates also with the link 601 rotatably fixed to one end of the upper delivery roller 340 and the crank 602 provided with the pin 605 that fits to the long hole 604 formed on the other end side of the link 601 and is driven by the open-close drive motor 603. Other than those, the components not specifically explained are configured equivalently to and function equivalently to those indicated in FIGS. 10A and 10B and in FIGS. 20A and 20B.

In place of the open-close drive motor 603, a solenoid may also be used.

According to the present embodiment, in the spine forming device 3, from the upstream side, the conveyor belts 311 and 312, the conveying guide plates 315 and 316, the auxiliary clamping plates 320 and 321, the pressure clamping plates 325 and 326, the stop plate 330, and the delivery rollers 340 and 341 are provided being arranged in that order, and the link 601 that positions the delivery rollers 340 and 341 to the pressure contacting position where the both delivery rollers come close to each other, and the separated position and the crank 602 that drives the link 601 are further provided. The crank 602 is driven by the open-close drive motor 603 such that the delivery rollers 340 and 341 are separated before the flattened face formed on the back-face portion of the booklet reaches the conveying position of the upper and the lower delivery rollers 340 and 341, and are moved to the position where the delivery rollers 340 and 341 contact the surfaces of the booklet (front cover and rear cover) before the trailing end of the booklet reaches the delivery rollers 340 and 341 to convey the booklet in the delivery direction. Accordingly, the rollers of the delivery rollers 340 and 341 do not contact the corners formed by flattening the back-face portion of the booklet. As a consequence, the corners can be prevented from bearing excessive force of the nip of the rollers, making it possible to prevent deformed wrinkles, tears, and the like from forming in the flattened back-face portion (stitching portion). In this case, because it is not necessary to make the diameter of the delivery rollers 340 and 341 large, the device is prevented from growing in size.

In previously-described exemplary embodiments, a sheet bundle corresponds to a reference mark SB; a first conveying unit corresponds to an upper delivery roller 340 and a lower delivery roller 341; a driving unit corresponds to a link 601, a crank 602, and an open-close drive motor 603; a second conveying unit corresponds to an upper conveyor belt 311 and a lower conveyor belt 312; a stop unit corresponds to a stop plate 330; a first pressure clamping unit corresponds to an upper auxiliary clamping plate 320 and a lower auxiliary clamping plate 321; a second pressure clamping unit corresponds to an upper pressure clamping plate 325 and a lower pressure clamping plate 326; a spine forming device corresponds to a reference numeral 3; and an image forming device corresponds to a reference numeral 100. A conveying position corresponds to a nip position between the upper delivery roller 340 and the lower delivery roller 341. The configurations according to the present invention as described have a small-footprint and prevent wrinkles, tears, and the like from appearing on the spine of a sheet bundle or at the corners forming the spine, thereby ensuring the high quality finish of the spine formed portion.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A spine forming device comprising:

a spine forming unit configured to form a folding portion of a sheet bundle into a flat shape, the folding portion being a back-face portion of the sheet bundle having been folded in middle before entering the device;

a first conveying unit configured to deliver the sheet bundle which has been folded in middle, the first conveying unit includes a pair of rotating members each having a rotating axis thereof;

a second conveying unit configured to deliver the sheet bundle which has been folded in middle toward the first conveying unit; and a driving unit configured to drive the first conveying unit, wherein:

the spine forming unit is disposed between the first conveying unit and the second conveying unit to flatten out the folding portion in a direction from a leading end of the folding portion and in a direction from both sides of the folding portion, the first conveying unit is driven by the driving unit so that the first conveying unit takes a retracted position where no driving force is exerted on the sheet bundle, before the folding portion of the sheet bundle enters the first conveying unit, and so that the first conveying unit takes an abutting position to abut on the sheet bundle to exert conveying force on the sheet bundle, after the folding portion of the sheet bundle enters the first conveying unit, the first conveying unit takes an initial position in addition to the retracted position and the abutting position, and the driving unit controls the first conveying unit in such a manner that a distance between the rotating axes at the retracted position is greater than a distance between the rotating axes at the abutting position, and the distance between the rotating axes at the abutting position is greater than a distance between the rotating axes at the initial position.

2. The spine forming device according to claim 1, wherein the spine forming unit includes:

a stop unit configured to abut on the leading end of the folding portion of the sheet bundle;

a first pressure clamping unit and a second pressure clamping unit configured to clamp the sheet bundle in a thickness direction of the sheet bundle; and a control unit that controls the first conveying unit, the second conveying unit, the stop unit, the first pressure clamping unit, and the second pressure clamping unit, the second conveying unit, the first pressure clamping unit, the second pressure clamping unit, the stop unit, and the first conveying unit are arranged in this order from upstream to downstream in a sheet bundle conveying direction, and the control unit controls the second conveying unit so that the leading end of the folding portion of the sheet bundle abuts on the stop unit, controls the first pressure clamping unit to form a bulge at the leading end of the sheet bundle by clamping the sheet bundle on the upstream side, and controls the second pressure clamping unit to clamp the bulge of the sheet bundle, so as to form the folding portion of the sheet bundle into the flat shape.

3. The spine forming device according to claim 1, wherein the first conveying unit is configured to deliver the sheet bundle out of the device, and the second conveying unit is configured to accept the sheet bundle into the device and deliver the accepted sheet bundle toward the first conveying unit.

4. The spine forming device according to claim 1, wherein the driving unit sets one of the retracted position and the abutting position as a home position, and the driving unit moves the first conveying unit to the home position, and then moves the first conveying unit to the other of the retracted position and the abutting position.

5. A sheet processing system comprising at least a spine forming device, the spine forming device including:

a spine forming unit configured to form a folding portion of a sheet bundle into a flat shape, the folding portion being a back-face portion of the sheet bundle having been folded in middle before entering the device;

a first conveying unit configured to deliver the sheet bundle which has been folded in middle, the first conveying unit includes a pair of rotating members each having a rotating axis thereof;

a second conveying unit configured to deliver the sheet bundle which has been folded in middle toward the first conveying unit; and a driving unit configured to drive the first conveying unit, wherein:

the spine forming unit is disposed between the first conveying unit and the second conveying unit to flatten out the folding portion in a direction from a leading end of the folding portion and in a direction from both sides of the folding portion, the first conveying unit is driven by the driving unit so that the first conveying unit takes a retracted position where no driving force is exerted on the sheet bundle, before the folding portion of the sheet bundle enters the first conveying unit, and so that the first conveying unit takes an abutting position to abut on the sheet bundle to exert conveying force on the sheet bundle, after the folding portion of the sheet bundle enters the first conveying unit, the first conveying unit takes an initial position in addition to the retracted position and the abutting position, and the driving unit controls the first conveying unit in such a manner that a distance between the rotating axes at the retracted position is greater than a distance between the rotating axes at the abutting position, and the distance between the rotating axes at the abutting position is greater than a distance between the rotating axes at the initial position.

6. The sheet processing system according to claim 5, further comprising a saddle stitch bookbinding device configured to perform a saddle stitching on the sheet bundle and fold the saddle stitched sheet bundle in middle, before the sheet bundle enters the spine forming device.

7. The sheet processing system according to claim 6, wherein the saddle stitch bookbinding device includes a folding plate to fold the saddle stitched sheet bundle in middle, and the saddle stitch bookbinding device is disposed next to and before the spine forming device, so that the folding plate is located on an axis of the sheet bundle conveying direction defined by the first and second conveying units and a first clamping unit and a second clamping unit.

8. The sheet processing system according to claim 5, wherein the first conveying unit is configured to deliver the sheet bundle out of the device, and the second conveying unit is configured to accept the sheet bundle into the device and deliver the accepted sheet bundle toward the first conveying unit.

9. The sheet processing system according to claim 5, wherein the driving unit sets one of the retracted position and the abutting position as a home position, and the driving unit moves the first conveying unit to the home position, and then moves the first conveying unit to the other of the retracted position and the abutting position.

* * * * *